US011478122B2

(12) United States Patent
Son et al.

(10) Patent No.: US 11,478,122 B2
(45) Date of Patent: Oct. 25, 2022

(54) DISHWASHER AND METHOD OF CONTROLLING THE SAME

(71) Applicant: LG Electronics Inc., Seoul (KR)

(72) Inventors: Changwoo Son, Seoul (KR); Jaegwang Bae, Seoul (KR); Joonhyung Kang, Seoul (KR); Yongtae Kwon, Seoul (KR); Minehul Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 74 days.

(21) Appl. No.: 16/606,581

(22) PCT Filed: Mar. 20, 2018

(86) PCT No.: PCT/KR2018/003226
§ 371 (c)(1),
(2) Date: Oct. 18, 2019

(87) PCT Pub. No.: WO2018/174520
PCT Pub. Date: Sep. 27, 2018

(65) Prior Publication Data

US 2021/0113054 A1 Apr. 22, 2021

(30) Foreign Application Priority Data

Mar. 20, 2017 (KR) ..... 10-2017-0034843
Mar. 20, 2017 (KR) ..... 10-2017-0034844
(Continued)

(51) Int. Cl.
*A47L 15/42* (2006.01)
*A47L 15/00* (2006.01)
*A47L 15/22* (2006.01)

(52) U.S. Cl.
CPC ..... *A47L 15/4244* (2013.01); *A47L 15/0028* (2013.01); *A47L 15/0031* (2013.01);
(Continued)

(58) Field of Classification Search
CPC .. A47L 15/4244; A47L 15/00; A47L 15/0023; A47L 15/0028; A47L 15/0031;
(Continued)

(56) References Cited

U.S. PATENT DOCUMENTS

2006/0237048 A1* 10/2006 Weaver ..... A47L 15/4225 134/56 D
2006/0237052 A1* 10/2006 Picardat ..... A47L 15/4221 134/56 D
(Continued)

FOREIGN PATENT DOCUMENTS

EP 1649797 4/2006
JP H02152431 6/1990
(Continued)

OTHER PUBLICATIONS

Extended European Search Report in European Application No. 18771226.0, dated Aug. 7, 2020, 8 pages.
(Continued)

*Primary Examiner* — Douglas Lee
(74) *Attorney, Agent, or Firm* — Fish & Richardson P.C.

(57) ABSTRACT

Disclosed are a dishwasher that sprays wash water to wash dishes or cookware and a method of controlling the same. The method of controlling the dishwasher includes supplying wash water from an external water source to a sump and intermittently driving a washing pump to change the level of water around a filter, thereby removing filth from the filter.

17 Claims, 14 Drawing Sheets

(30) Foreign Application Priority Data

Jul. 18, 2017 (KR) ..... 10-2017-0091131
Aug. 31, 2017 (KR) ..... 10-2017-0111512

(52) U.S. Cl.
CPC ..... *A47L 15/22* (2013.01); *A47L 15/4206* (2013.01); *A47L 15/4289* (2013.01); *A47L 2401/09* (2013.01); *A47L 2501/01* (2013.01)

(58) Field of Classification Search
CPC ..... A47L 15/22; A47L 15/42; A47L 15/4202; A47L 15/4206; A47L 15/4289; A47L 2401/09; A47L 2501/01
See application file for complete search history.

(56) References Cited

U.S. PATENT DOCUMENTS

2009/0133719 A1* 5/2009 Park ..... A47L 15/0049 134/18
2009/0211600 A1* 8/2009 Steiner ..... A47L 15/4204 134/10
2010/0206332 A1* 8/2010 Kim ..... A47L 15/0007 134/18
2012/0055511 A1* 3/2012 Kim ..... A47L 15/4208 134/10

FOREIGN PATENT DOCUMENTS

JP 2007325789 12/2007
JP 2008036130 2/2008
JP 2011000321 1/2011
KR 1020120022428 3/2012
KR 1020130136354 12/2013
WO WO-2005089621 A1 * 9/2005 ..... A47L 15/4225

OTHER PUBLICATIONS

PCT International Search Report in International Application No. PCT/KR2018/003226, dated Sep. 19, 2018, 7 pages (with English translation).

* cited by examiner

| | | | | | | |
|---|---|---|---|---|---|---|
| PRELIMINARY WASHING 1 (P310) | PRELIMINARY WASHING 2 (P320) | PRELIMINARY WASHING 3 (P330) | MAIN WASHING (P340) | FILTER WASHING (P350) | RINSING (P360) | HEATING RINSING (P370) |

DISHWASHER AND METHOD OF CONTROLLING THE SAME

CROSS-REFERENCE TO RELATED APPLICATIONS

This application is a National Stage application under 35 U.S.C. § 371 of International Application No. PCT/KR2018/003226, filed on Mar. 20, 2018, which claims the benefit of Korean Application No. 10-2017-0111512, filed on Aug. 31, 2017, Korean Application No. 10-2017-0091131, filed on Jul. 18, 2017, Korean Application No. 10-2017-0034844, filed on Mar. 20, 2017, and Korean Application No. 10-2017-0034843, filed on Mar. 20, 2017. The disclosures of the prior applications are incorporated by reference in their entirety.

TECHNICAL FIELD

The present invention relates to a dishwasher and a method of controlling the same, and more particularly to a dishwasher that sprays wash water to wash dishes or cookware and a method of controlling the same.

BACKGROUND ART

A dishwasher is an electric home appliance that removes filth, such as food waste, from dishes or cookware (hereinafter referred to as "objects to be washed") using high-pressure wash water sprayed from a spray arm.

In general, a dishwasher includes a tub having a washing chamber defined therein and a sump mounted at the bottom of the tub to store wash water. Wash water is moved to a spray arm by a pumping action of a washing pump mounted in the sump, and the wash water moved to the spray arm is sprayed at a high pressure through a spray port formed in the spray arm. The wash water sprayed at the high pressure strikes the surfaces of objects to be washed, whereby filth is separated from the objects to be washed and then falls to the bottom of the tub.

A filter that filters wash water and allows the filtered wash water to flow to the sump is disposed at the bottom of the tub. The filter includes an inlet, through which wash water is introduced, and a mesh that filters filth. In the case in which filth clogs the inlet or covers the mesh, wash water is not smoothly circulated, whereby washing performance is deteriorated.

DISCLOSURE

Technical Problem

It is an object of the present invention to provide a dishwasher capable of removing filth clogging a filter and a method of controlling the same.

The objects of the present invention are not limited to the above-mentioned object, and other objects that have not been mentioned above will become evident to those skilled in the art from the following description.

Technical Solution

In accordance with an aspect of the present invention, the above object can be accomplished by the provision of a method of controlling a dishwasher, the method including supplying wash water from an external water source to a sump (a water supply step) and intermittently driving a washing pump to change the level of water around a filter (an intermittent driving step).

The intermittent driving step may include driving the washing pump to pump the wash water stored in the sump to at least one of a plurality of spray arms (a driving step) and stopping the washing pump to collect the wash water pumped to the at least one of the spray arms to the sump (a stopping step), and, at the stopping step, the level of the wash water collected to the sump may be lower than the bottom of a tub.

The filter may include an inlet formed in an upper circumference thereof so as to allow wash water in the tub to be introduced therethrough and a mesh portion disposed at a lower part thereof so as to collect filth, and, at the stopping step, the level of the wash water collected to the sump may be lower than a lower end of the inlet and may not exceed an upper end of the mesh portion.

The spray arms may be disposed in an upward-downward direction, and, at the driving step, the washing pump may pump wash water to an spray arm disposed at the uppermost end, among the spray arms.

At the water supply step, the level of the wash water supplied to the sump may be lower than the bottom of the tub.

The filter may include an inlet formed in an upper circumference thereof so as to allow wash water in the tub to be introduced therethrough and a mesh portion disposed at a lower part thereof so as to collect filth, and, at the water supply step, the level of the wash water supplied to the sump may be lower than a lower end of the inlet and may not exceed an upper end of the mesh portion.

The driving step may be performed for a predetermined driving time, the stopping step may be performed for a predetermined stopping time, and the driving time may be longer than the stopping time.

The driving step and the stopping step may be repeatedly performed.

The method may further include draining the wash water stored in the sump outside (a drainage step) after repetition of the driving step and the stopping step.

The method may further include spraying wash water through the spray arms to remove filth from an object to be washed (a washing step) and draining the wash water stored in the sump outside (a drainage step), wherein the water supply step may be performed after the drainage step.

The method may further include driving the washing pump to spray wash water through at least one of the spray arms (a strong spraying step) after the water supply step.

The spray arms may be disposed in an upward-downward direction, and, at the strong spraying step, wash water may be sprayed through an spray arm disposed at the lowermost end so as to spray the wash water from below to above, among the spray arms.

At the strong spraying step, the washing pump may be intermittently driven to intermittently spray wash water, and a driving period of the washing pump at the strong spraying step may be longer than a driving period of the washing pump at the intermittent driving step.

At the strong spraying step, the value of current of the washing pump may be compared with a predetermined clogging determination current value.

The intermittent driving step may be performed when the case in which the value of current of the washing pump is lower than the clogging determination current value occurs a predetermined number of times at the strong spraying step.

The speed of the washing pump at the strong spraying step may be lower than the speed of the washing pump at the intermittent driving step.

At the intermittent driving step, the value of current of the washing pump may be measured during a driving period of the washing pump.

At the intermittent driving step, a value obtained by integrating the value of current of the washing pump measured during the driving period of the washing pump may be compared with a predetermined disentanglement determination value, and the intermittent driving step may be finished when the integrated value is greater than the disentanglement determination value.

In accordance with another aspect of the present invention, there is provided a dishwasher including a tub, a plurality of spray arms, a sump, a filter, a washing pump, a water supply valve, and a controller configured to control the washing pump and the water supply valve, wherein the controller is configured to control the water supply valve in order to supply wash water from an external water source to the sump and to intermittently drive the washing pump in order to change the level of water around the filter.

The filter may include an inlet formed in an upper circumference thereof so as to allow wash water in the tub to be introduced therethrough and a mesh portion disposed at a lower part thereof so as to collect filth.

The controller may be configured to control the washing pump and the water supply valve such that the level of water around the filter is changed between an upper end and a lower end of the mesh portion.

The controller may be configured to control the washing pump and the water supply valve such that the level of water around the filter is changed between an upper side of an upper end of the inlet and a lower end of the inlet.

The details of other embodiments are included in the following description and the accompanying drawings.

Advantageous Effects

The washing machine according to the present invention and the method of controlling the same have one or more of the following effects.

First, it is possible to enable wash water to flow backwards using a head of the wash water, whereby it is possible to remove small filth from the mesh of the filter.

Second, it is possible to drain the small filth separated from the mesh of the filter together with the wash water without being discharged out of the filter.

Third, it is possible to determine whether the filter is clogged while performing strong spraying in which the wash water is strongly sprayed to remove filth from objects to be washed, whereby it is possible to efficiently remove the filth from the objects to be washed.

Fourth, it is possible to remove filth immediately when clogging of the filter is sensed in the strong spraying, whereby it is possible to improve washing performance.

Fifth, it is possible to determine whether the clogging of the filter has been solved while the clogging of the filter is solved and to interrupt disentanglement based on the determination, whereby it is possible to minimize disentanglement time.

Sixth, it is possible to automatically wash the filter, whereby it is not necessary for a user to separately clean the filter.

It should be noted that effects of the present invention are not limited to the effects of the present invention as mentioned above, and other unmentioned effects of the present invention will be clearly understood by those skilled in the art from the following claims.

DESCRIPTION OF DRAWINGS

FIG. 6 is a view showing the operation of a control construction in a preliminary washing cycle of the dishwasher according to the embodiment of the present invention.

BEST MODE

Advantages, features and methods for achieving those of embodiments may become apparent upon referring to embodiments described later in detail together with the attached drawings. However, embodiments are not limited to the embodiments disclosed hereinafter, but may be embodied in different modes. The embodiments are provided for perfection of the disclosure and informing a scope to persons skilled in this field of art. The same reference numbers may refer to the same elements throughout the specification.

Hereinafter, embodiments of the present invention will be described with reference to the drawings provided to describe a dishwasher and a method of controlling the same.

Figure 1:
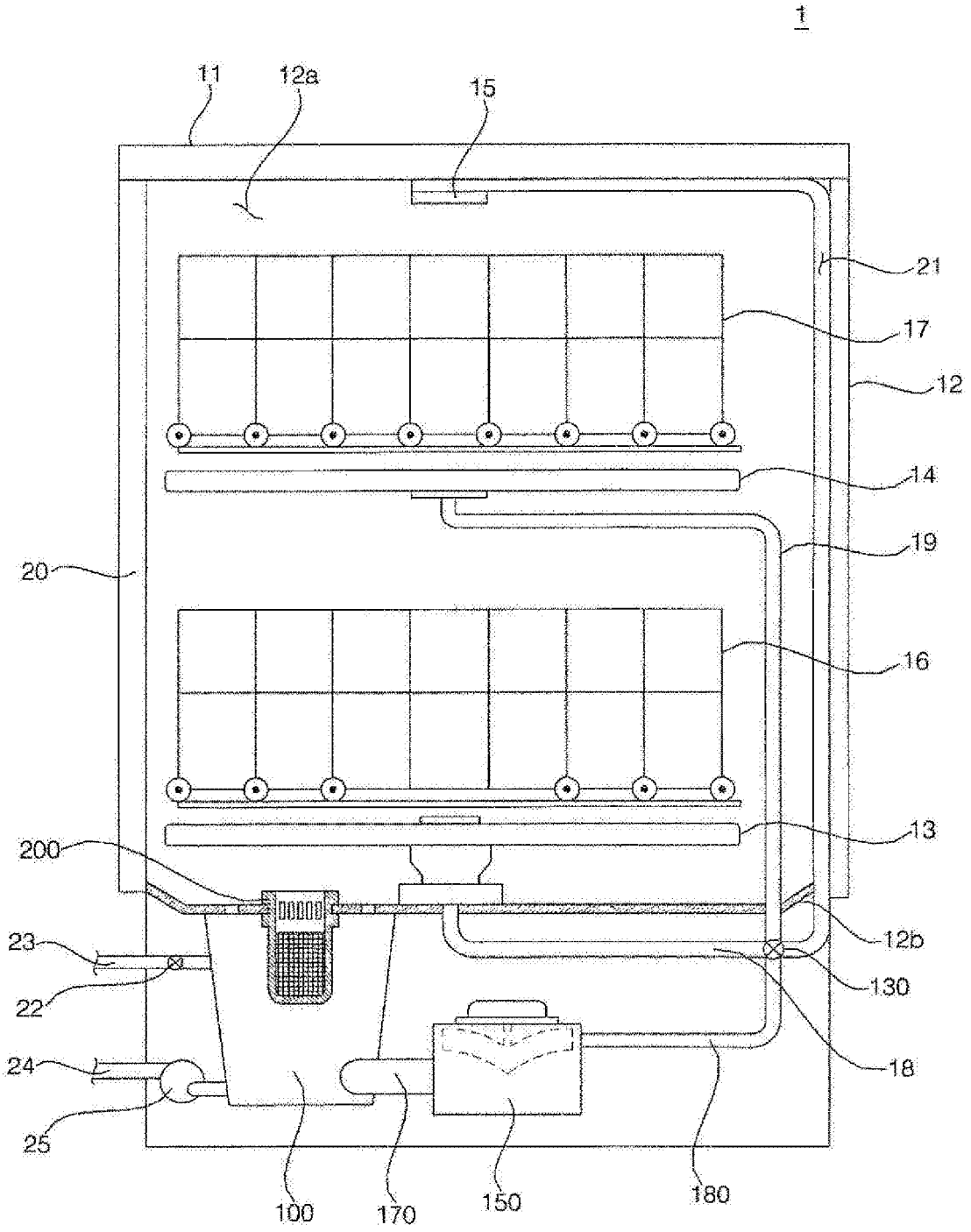
FIG. 1 is a sectional view of a dishwasher according to an embodiment of the present invention.
Figure 2:
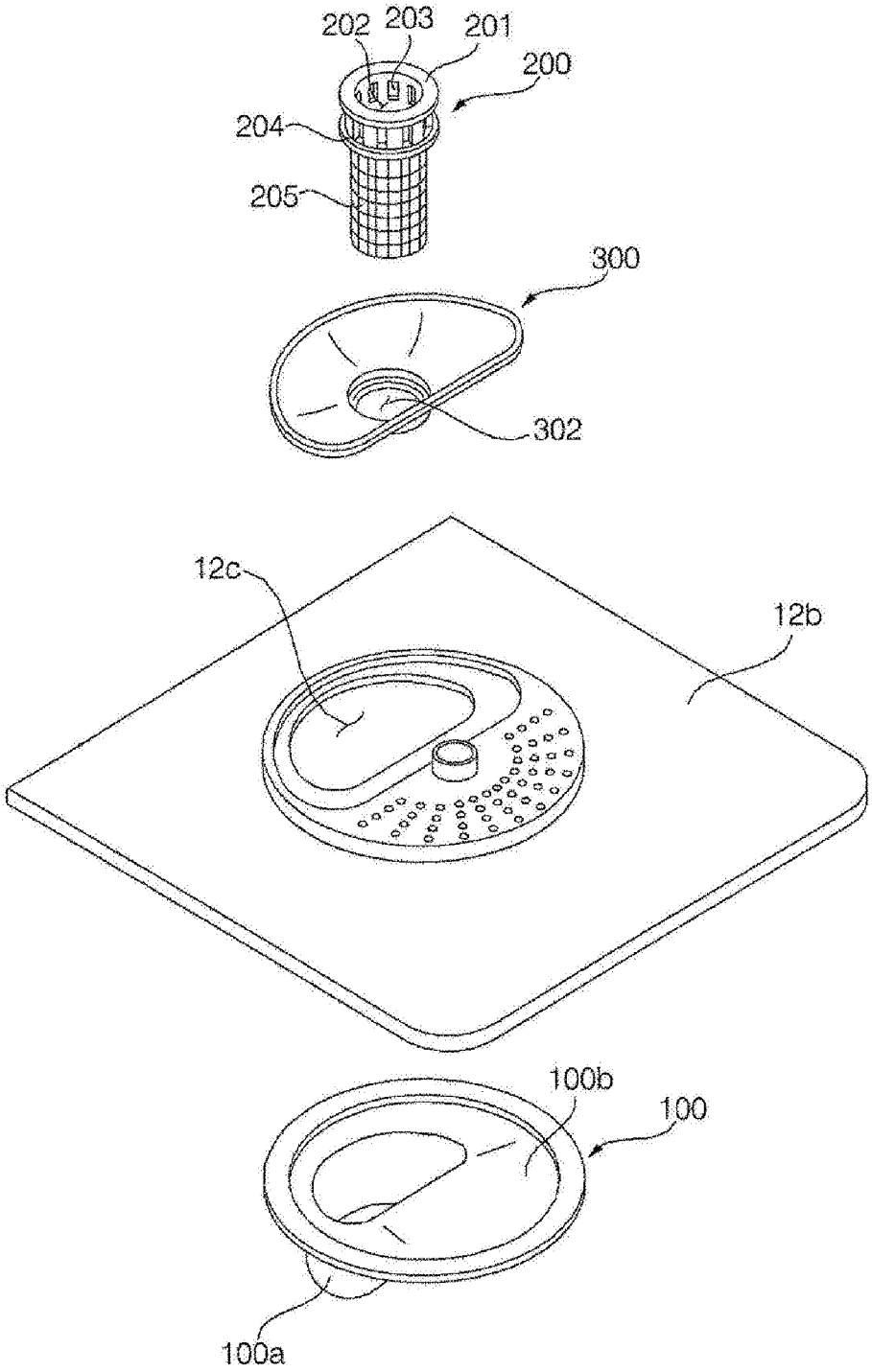
FIG. 2 is a partial development perspective view of the dishwasher according to the embodiment of the present invention.

FIG. 1 is a sectional view of a dishwasher according to an embodiment of the present invention, and FIG. 2 is a partial development perspective view of the dishwasher according to the embodiment of the present invention.

The dishwasher 1 according to the embodiment of the present invention includes a case 11 defining the external appearance thereof, a tub 12 in which objects to be washed are received, a door 20 provided at the front surface of the tub 12 to open and close the tub 12, a sump 100 disposed at the lower side of the tub 12 to store wash water, a plurality of spray arms 13, 14, and 15 for spraying wash water into the tub 12, a filter 200 for filtering wash water sprayed from at least one of the spray arms 13, 14, and 15 and then collected to the sump 100, a washing pump 150 for pumping wash water stored in the sump 100, and a switch valve 130 for guiding the wash water pumped by the washing pump 150 to at least one of the spray arms 13, 14, and 15.

The tub 11 is formed in a hexahedral shape open at the front surface thereof to define a washing chamber 12*a* therein. A communication hole 12*c*, through which wash water is introduced into the sump 100, is formed in a bottom 12*b* of the tub 11. A plurality of racks 16 and 17, on which objects to be washed are received, is provided in the washing chamber 12*a*. The racks 16 and 17 include a lower rack 16 disposed at the lower part of the washing chamber 12*a* and an upper rack 17 disposed at the upper part thereof. The lower rack 16 and the upper rack 17 are disposed so as to be spaced apart from each other in the upward-downward direction, and may slide to the front of the tub 11 so as to be withdrawn.

The spray arms 13, 14, and 15 are disposed in the upward-downward direction. The spray arms 13, 14, and 15 include a lower spray arm 13 disposed at the lowermost end for spraying wash water from below to above toward the lower rack 16, an upper spray arm 14 disposed at the upper side of the lower spray arm 13 for spraying wash water from below to above toward the upper rack 17, and a top spray arm 15 disposed at the upper end of the washing chamber 12*a*, which is located at the upper side of the upper spray arm 14, for spraying wash water from above to below.

The spray arms 13, 14, and 15 receive wash water from the washing pump 150 via a plurality of spray arm connection channels 18, 19, and 21. The spray arm connection channels 18, 19, and 21 include a lower spray arm connection channel 18 connected to the lower spray arm 13, an upper spray arm connection channel 19 connected to the upper spray arm 14, and a top spray arm connection channel 21 connected to the top spray arm 15.

The lower spray arm 13, the upper spray arm 14, and the top spray arm 15 receive wash water from the washing pump 150 via the lower spray arm connection channel 18, the upper spray arm connection channel 19, and the top spray arm connection channel 21, respectively.

The sump 100 is disposed at the lower side of the bottom 12*b* of the tub 12 to collect wash water. The sump 100 includes a water collection portion 100*a* for storing collected wash water and a sump body 100*b* for fixing the water collection portion 100*a* to the bottom 12*b* of the tub 12.

The sump body 100*b* is fixed to the bottom 12*b* of the tub 12, and is disposed at the lower part of the tub 12. The sump body 100*b* is fixed to the bottom 12*b* of the tub 12 so as to surround the communication hole 12*c*, which is formed through the bottom 12*b* of the tub 12. Meanwhile, the sump body 100*b* may have an inclined surface for guiding wash water to the water collection portion 100*a*.

A support unit 300 is settled on the bottom 12*b* of the tub 12 to cover the communication hole 12*c* and to support the filter 200. A support through-hole 302, to which the filter 200 is coupled, is formed in the support unit 300. When coupled to the bottom 12*b* of the tub 12, the support unit 300 defines the bottom 12*b* of the tub 12. In some embodiments, the support unit 300 may be formed integrally with the bottom 12*b* of the tub 12. The support through-hole 302 is formed so as to correspond to the water collection portion 100*a* of the sump 100 such that the tub 12 and the sump 100 communicate with each other. The support unit 300 is formed so as to be inclined such that wash water flows to the support through-hole 302.

The filter 200 removes filth from wash water moving from the tub 123 to the sump 100. The filter 200 includes a cylindrical upper filter portion 201, which forms the upper part thereof so as to protrude to the upper side of the support unit 200, a ring-shaped body protrusion 204 settled in the circumference of the support through-hole 302 of the support unit 300, and a cylindrical mesh portion 205 for filtering wash water and collecting filth.

An inlet 203, through which wash water on the bottom 12*b* of the tub 12 is introduced into the upper filter portion 201, is formed in the circumference of the upper filter portion 201. A plurality of inlets 203 is formed along the circumferential surface of the upper filter portion 201, which is the upper part of the filter 200. The inlet 203 is a passage, through which wash water on the bottom 12*b* of the tub 12 is introduced into the upper filter portion 201, and is a means for preventing relatively large filth from being introduced into the upper filter portion 201. A relatively large opening 202, through which wash water in the tub 12 is introduced into the upper filter portion 201, is formed in the upper surface of the upper filter portion 201.

The body protrusion 204 is formed at the lower end of the upper filter portion 201. The body protrusion 204 protrudes horizontally in the radial direction, and is coupled to the circumference of the support through-hole 302 of the support unit 300.

The mesh portion 205 is formed so as to extend to the lower side of the body protrusion 204. The mesh portion 205 protrudes to the lower side of the support unit 300, and is disposed in the water collection portion 100*a* of the sump 100. A mesh for filtering filth from wash water passing therethrough is provided at the circumference of the mesh portion 205.

Wash water sprayed through the spray arms 13, 14, and 15 falls to the bottom 12*b* of the tub 12 together with filth attached to the objects to be washed. The wash water flowing on the bottom 12*b* of the tub 12 is collected into the upper filter portion 201 of the filter 200 from the support unit 300. The wash water flowing to the upper filter portion 201 is introduced into the mesh portion 205 through the opening 202 and the inlet 203. The wash water introduced into the mesh portion 205 passes through the mesh of the mesh portion 205, by which filth is removed from the wash water, and is then stored in the water collection portion 100*a* of the sump 100. Consequently, the filth is collected in the mesh portion 205, and a user may separate the filter 200 in order to remove the filth from the mesh portion 205.

Relatively large filth flowing together with wash water may not pass through the inlet 203 of the upper filter portion 201 and may thus clog the inlet 203. In the case in which there is a large amount of large filth, the inlet 203 may be clogged by the filth, whereby wash water may not be smoothly introduced into the water collection portion 100*a* of the sump 100.

In addition, small filth in the mesh portion 205 is attached to the mesh of the mesh portion 205. In the case in which a large amount of filth is attached to the mesh portion 205, wash water in the mesh portion 205 does not smoothly pass through the mesh portion 205, whereby wash water is not smoothly circulated.

The water collection portion 100*a* of the sump 100 is connected to the washing pump 150 via a water collection channel 170. Wash water stored in the water collection portion 100*a* flows to the washing pump 150 via the water collection channel 170.

The washing pump 150 supplies wash water stored in the water collection portion 100*a* of the sump 100 to at least one of the spray arms 13, 14, and 15. The washing pump 150 includes a washing motor for generating rotary force and an impeller rotated by the washing motor for pumping wash water. The washing pump 150 is connected to the switch valve 130 via a wash water supply channel 180. When the washing pump 150 is driven, wash water stored in the water collection portion 100*a* of the sump 100 is introduced into the washing pump 150 via the water collection channel 170, and is pumped to the switch valve 130 via a wash water supply channel 180.

The switch valve 130 selectively supplies wash water pumped by the washing pump 150 to at least one of the lower spray arm 13, the upper spray arm 14, or the top spray arm 15. The switch valve 130 selectively connects the wash water supply channel 180 to at least one of the spray arm connection channels 18, 19, and 21.

The water collection portion 100*a* of the sump 100 is connected to a water supply channel 23, in which wash water supplied from an external water source flows. A water supply valve 22 for controlling wash water supplied from the external water source is provided in the water supply channel 23. The water supply valve 22 supplies wash water from the external water source to the water collection portion 100*a* of the sump 100. When the water supply valve 22 is opened, wash water supplied from the external water source is introduced into the water collection portion 100*a* of the sump 100 via the water supply channel 23.

A drainage channel 24 for draining water in the water collection portion 100*a* of the sump 100 out of the dishwasher 1 is connected to the water collection portion 100*a* of the sump 100. A drainage pump 25 for draining wash water in the water collection portion 100*a* via the drainage channel 24 is provided in the drainage channel 24. When the drainage pump 25 is driven, wash water stored in the water collection portion 100*a* of the sump 100 is drained out of the case 11 via the drainage channel 24.

A heater (not shown) for heating wash water may be provided at the water collection portion 100*a* of the sump 100 or at the washing pump 150.

Figures 3, 4:
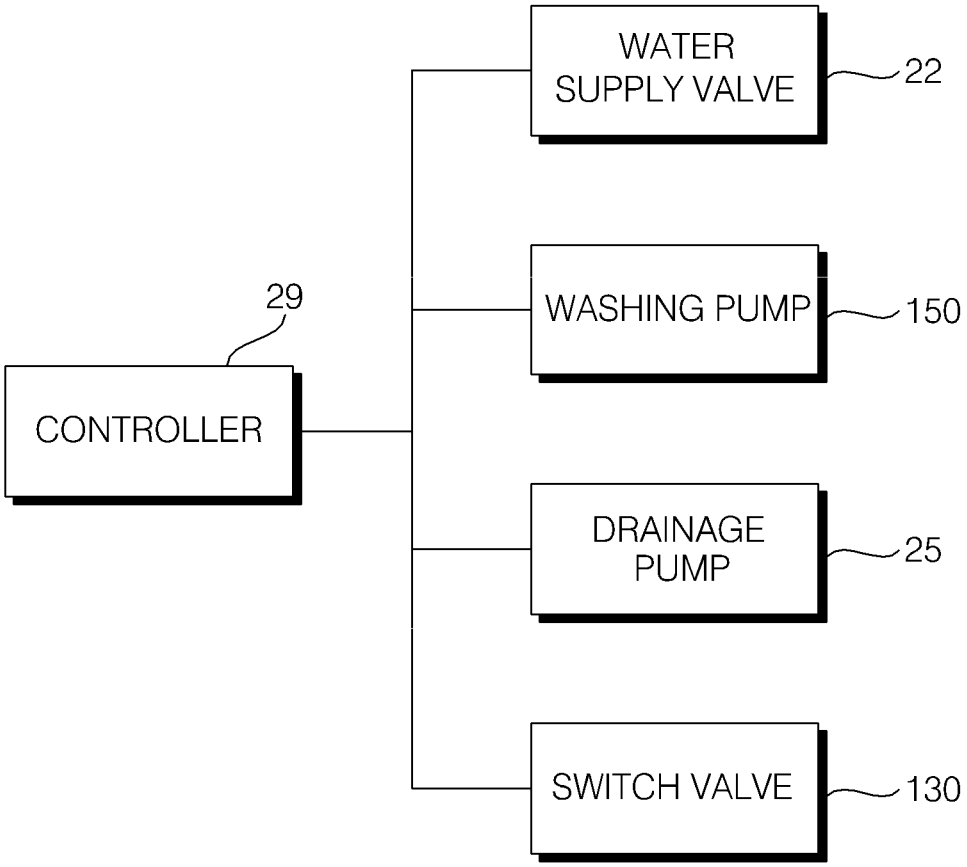
FIG. 3 is a block diagram of the dishwasher according to the embodiment of the present invention.
FIG. 4 is a view showing each cycle in a general washing course of the dishwasher according to the embodiment of the present invention.

FIG. 3 is a block diagram of the dishwasher according to the embodiment of the present invention, and FIG. 4 is a view showing each cycle in a general washing course of the dishwasher according to the embodiment of the present invention.

A controller 29 controls the water supply valve 22, the washing pump 150, a drainage pump 25, and the switch valve 130 to wash objects to be washed. The controller 29 performs each cycle according to a washing course selected by a user.

In a general washing course for washing, the controller 29 sequentially performs preliminary washing 1 (P310), preliminary washing 2 (P320), preliminary washing 3 (P330), main washing (P340), filter washing (P350), rinsing (P360), and heating rinsing (P370).

Each preliminary washing (P310, P320, or P330) is a cycle for spraying wash water to the objects to be washed to remove filth from the objects to be washed. In each preliminary washing (P310, P320, or P330), the controller 29 controls the water supply valve 22 to supply wash water from the external water source to the water collection portion 100*a* of the sump 100. The controller 29 drives the washing pump 150 to pump wash water in the water collection portion 100*a* of the sump 100, and controls the switch valve 130 to spray wash water through at least one of the spray arms 13, 14, and 15. Wash water sprayed through at least one of the spray arms 13, 14, and 15 drops filth attached to the objects to be washed to the bottom 12*b* of the tub 12 so as to be collected in the filter 200. The controller 29 drives the drainage pump 25 to drain wash water stored in the water collection portion 100*a* of the sump 100 outside.

In each preliminary washing (P310, P320, or P330), when the inlet 203 of the filter 200 is clogged by filth, the controller 29 may sense the same, and may solve this problem. In the state in which the speed of the washing pump 150, i.e. the rotational speed (rpm) of the motor of the washing pump 150, is uniform, the magnitude of a load of the motor is proportional to torque generated in the motor. The torque generated in the motor is proportional to the value of current flowing in the motor.

Here, the load of the motor may be the amount of wash water pumped by the impeller of the washing pump 150. In the case in which a sufficient amount of water is not pumped at uniform rpm, the load of the motor is reduced. Consequently, the torque generated in the motor decreases, and the value of current flowing in the motor decreases.

In the present invention, the amount of wash water and clogging of the filter 200 are determined in consideration of relationships among the load of the motor, the rotational speed of the motor, the torque of the motor, the amount of wash water that is pumped, and value of current flowing in the motor.

When the spray arms 13, 14, and 15 spray wash water to perform washing, the motor of the washing pump 150 is controlled to be driven at a target rpm. In a period in which the washing pump 150 starts pumping and in a period in which the washing pump 150 ends pumping, the rpm of the motor is lower than the target rpm, and has a great rate of change.

The controller 29 controls the value of current supplied to the motor of the washing pump 150. That is, the controller performs control such that the motor is driven at the target rpm through rpm that is fed back and then spraying is performed. In a stable period between the start period and the end period, the motor is driven at substantially the target rpm, a change in the value of current flowing in the motor is not great.

Consequently, it is preferable to measure the value of current supplied to the motor in the stable period, i.e. in the period in which the motor is driven at the target rpm.

When the pump is driven at normal rpm to pump a normal flow rate, a change in the value of current flowing in the motor is slight. Consequently, it is possible to set the value of current to a normal reference value. In the case in which the value of current in the stable period is less than the reference value, the flow rate is smaller, which means that the amount of wash water that is pumped is reduced. Consequently, the value of current flowing in the motor may be measured to determine deficiency of wash water or clogging of the filter.

A detailed description thereof will be given with reference to FIG. 4.

The main washing (P340) is a cycle for spraying heated wash water to the objects to be washed to remove filth from the objects to be washed while heating the objects to be washed. In the main washing (P340), the controller 29 controls the water supply valve 22 to supply wash water from the external water source into the water collection portion 100*a* of the sump 100, controls the heater to heat the wash water, drives the washing pump 150 to spray the heated wash water through at least one of the spray arms 13, 14, and 15, and drives the drainage pump 25 to drain the wash water in the water collection portion 100*a* of the sump 100 outside.

The filter washing (P350) is a cycle for removing small filth attached to the mesh portion 205 of the filter 200. A detailed description of the filter washing (P350) will be given with reference to FIG. 4.

The rinsing (P360) is a cycle for removing residual filth from the objects to be washed. In the rinsing (P360), the controller 29 controls the water supply valve 22 to supply wash water from the external water source into the water collection portion 100*a* of the sump 100, drives the washing pump 150 to spray the wash water through at least one of the spray arms 13, 14, and 15, and drives the drainage pump 25 to drain the wash water in the water collection portion 100*a* of the sump 100 outside.

The heating rinsing (P370) is a cycle for spraying heated wash water to the objects to be washed to heat the objects to be washed. In the heating rinsing (P370), the controller 29 controls the water supply valve 22 to supply wash water from the external water source into the water collection portion 100*a* of the sump 100, controls the heater to heat the wash water, drives the washing pump 150 to spray the heated wash water through at least one of the spray arms 13, 14, and 15, and drives the drainage pump 25 to drain the wash water in the water collection portion 100*a* of the sump 100 outside.

Figure 5:
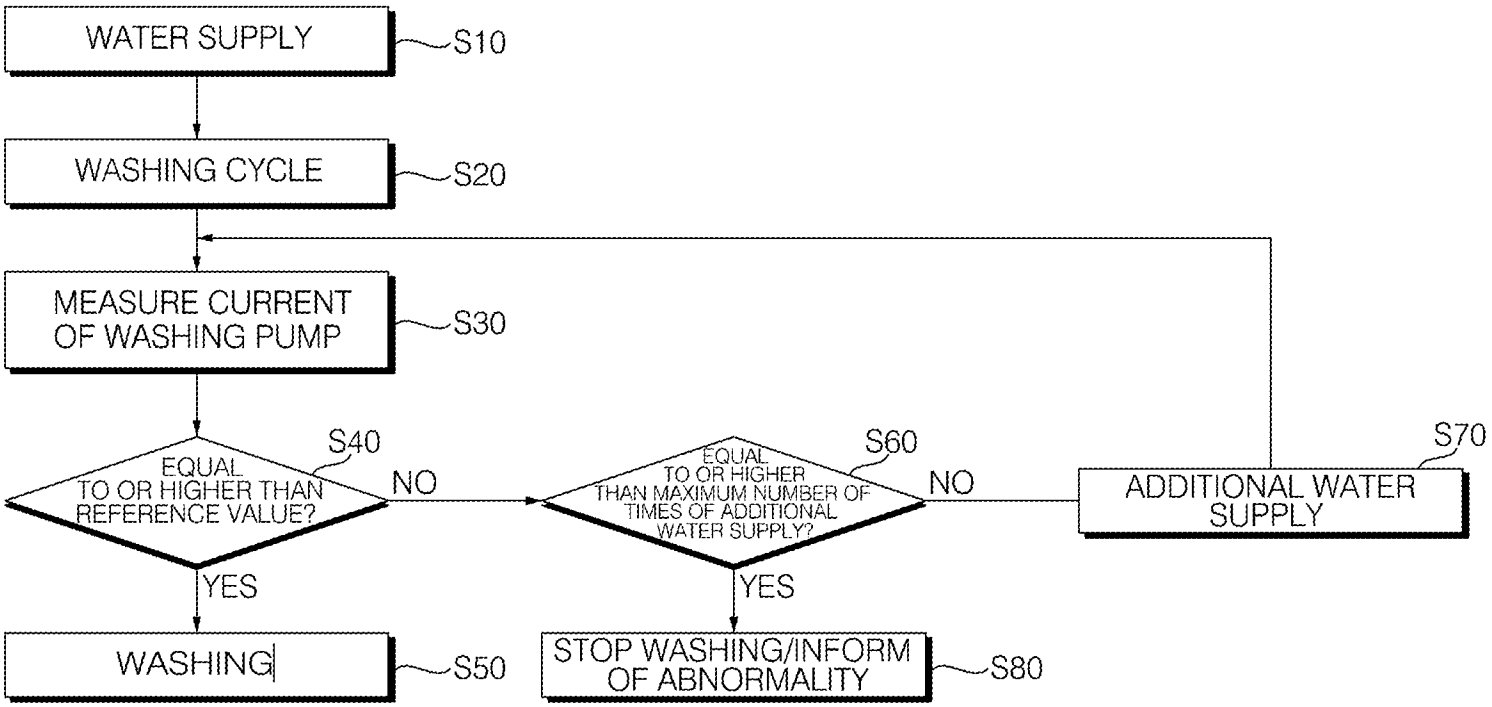
FIG. 5 is a view showing a method of controlling the dishwasher according to the embodiment of the present invention.
Figure 7:
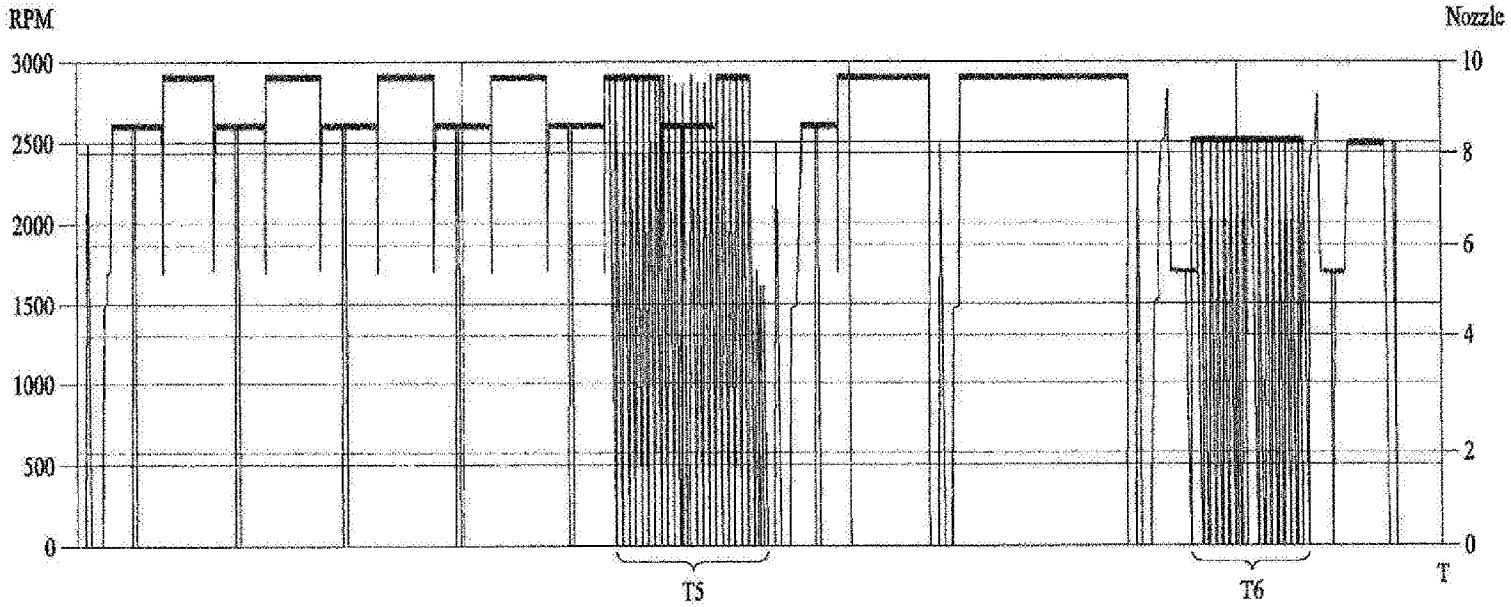
FIG. 7 is a view showing the operation of a control construction in a main washing cycle and a rinsing cycle of the dishwasher according to the embodiment of the present invention.
Figure 8:
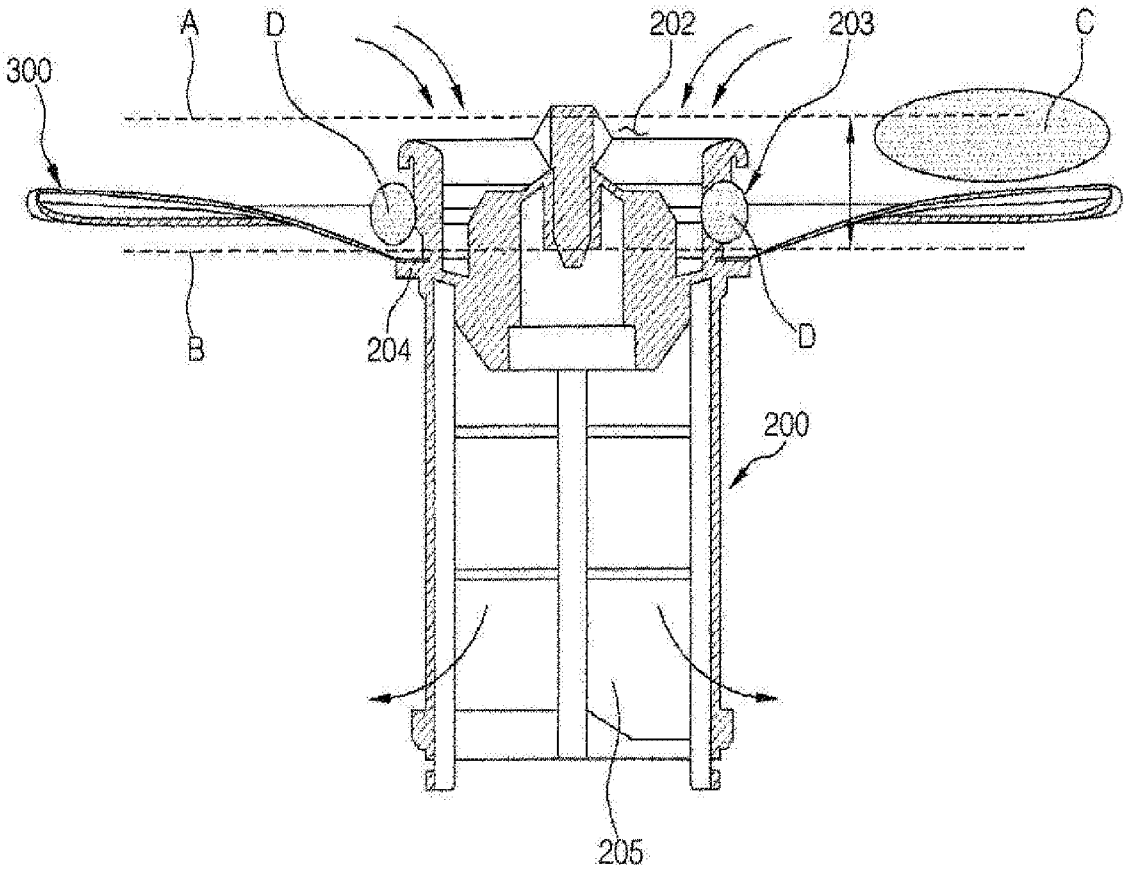
FIG. 8 is a view showing an example of a disentanglement operation of the dishwasher according to the embodiment of the present invention.
Figure 9:
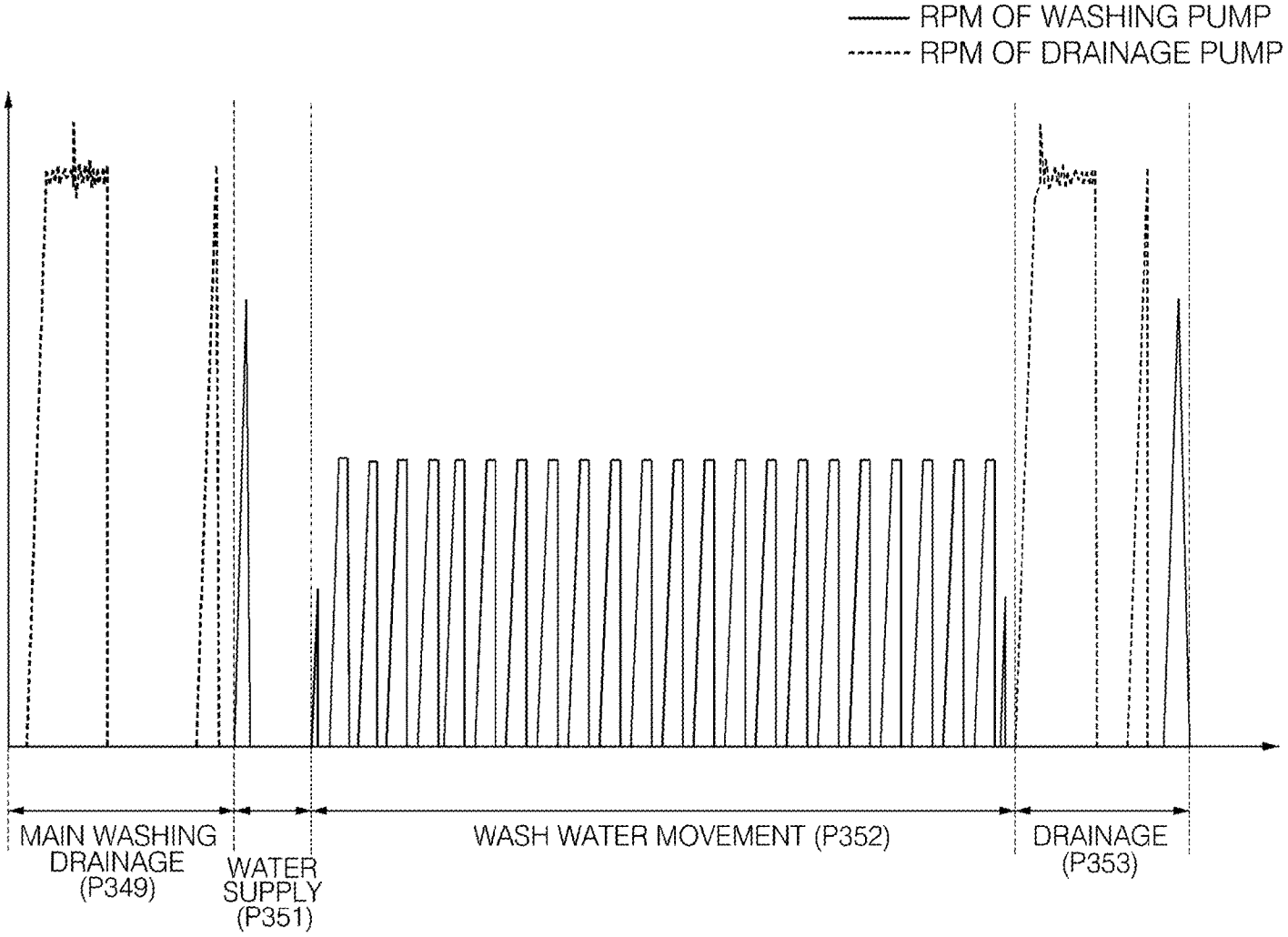

FIG. 5 is a view showing a method of controlling the dishwasher according to the embodiment of the present invention, FIG. 6 is a view showing the operation of a control construction in a preliminary washing cycle of the dishwasher according to the embodiment of the present invention, FIG. 7 is a view showing the operation of a control construction in a main washing cycle and a rinsing cycle of the dishwasher according to the embodiment of the present invention, and FIG. 8 is a view showing an example of a disentanglement operation of the dishwasher according to the embodiment of the present invention.

In order to perform washing, water supply (S10) is performed first. When the water supply is completed, a washing cycle (S20) is performed. The washing cycle may be one of the preliminary washing 1 (P310), the preliminary washing 2 (P320), the preliminary washing 3 (P330), the main washing (P340), and the rinsing (P360).

While the washing cycle is performed, i.e. while a spraying step is performed, the value of current flowing in the washing pump 150 is measured (S30), and a wash water amount determination step (S40) is performed. At the wash water amount determination step, whether the measured value of current is higher or lower than a predetermined reference value is determined. In the case in which the measured value of current is higher than the reference value, it may be determined that the amount of wash water is normal. In the case in which the measured value of current is lower than the reference value, it may be determined that the amount of wash water is deficient.

In the case in which it is not determined that the amount of wash water is deficient at the wash water amount determination step, the spraying step is continuously performed (S50). Consequently, the wash water amount determination step may be repeatedly performed during the spraying step. In the case in which it is determined that the amount of wash water is deficient at the wash water amount determination step, it is preferable to pause the spraying step. Subsequently, a step of solving deficiency of wash water may be performed. The deficiency of wash water may be solved by additionally supply wash water. Since the deficiency of wash water may be caused substantially due to clogging of the filter 200, a step of solving clogging of the filter 200 may be performed.

An embodiment of the present invention provides an example of solving the deficiency of wash water through additional supply of wash water.

Water may be supplied toward the filter 200 via the water supply channel 23. In the case in which wash water is deficient, the level of water in the water collection portion 100*a* of the sump 100 may be lower than the filter 200. Consequently, wash water may be supplied toward the filter 200 in order to solve clogging of the filter 200. Of course, the amount of wash water that is additionally supplied is preferably smaller than the amount of wash water that is initially supplied.

Additional water supply may be performed whenever it is determined that the amount of wash water is deficient. That is, a spraying step may be performed after additional water supply, and additional water supply may be performed again upon determining that the amount of wash water is deficient. However, a large number of times of additional water supply may mean that an excessive amount of wash water is supplied into the dishwasher. This may mean abnormality, such as leakage of water, rather than clogging of the filter. Of course, fundamentally, this may be a problem of very serious clogging of the filter that can be solved by additional water supply.

Consequently, it is preferable to perform a number-of-times determination step (S60) of counting the number of times of additional water supply and preventing additional water supply from being performed a predetermined number of times or more before the additional water supply. As an example, in the case in which the number of times of additional water supply is five, it is preferable to perform washing stop and abnormality notification (S80) without additional water supply upon determining that the amount of wash water is deficient after five times of additional water supply.

In the above embodiment, no separate mechanical construction for determining deficiency in the amount of wash water is needed, whereby it is possible to simply and easily determine deficiency in the amount of wash water. In addition, additional water supply is performed toward the filter 200, whereby it is possible to somewhat solve clogging of the filter.

Hereinafter, another embodiment of the present invention will be described. In this embodiment, the spraying step includes an intermittent driving step. That is, an intermittent driving step of repeatedly performing spraying and pause of spraying is included. The intermittent driving step is performed to artificially changing the level of water around the filter 200 in order to solve clogging of the filter 200. That is, wash water is not continuously sprayed but spraying and pause of spraying are repeated to artificially changing the level of water around the filter 200.

It is possible to solve clogging of the filter 200 through such a change in the level of water, as will be described below. That is, it is possible to prevent clogging of the filter 200.

Prevention or solution of clogging of the filter 200 through the intermittent driving step may be performed in conjunction with the previous embodiment. That is, upon sensing deficiency of wash water or clogging of the filter 200, the intermittent driving step may be performed in order to solve the clogging of the filter 200, instead of general continuous spraying. In addition, additional water supply may be performed before the intermittent driving step is performed. Of course, spraying may be performed through intermittent driving after additional water supply is performed in order to prevent clogging of the filter 200.

Hereinafter, the intermittent driving step will be described in detail.

A conventional dishwasher focuses on removal of filth from objects to be washed by increasing the intensity of wash water, the spraying time of wash water, and the amount of wash water. In the case in which washing is completed in the sequence of the preliminary washing, the main washing, and the rinsing, the removed filth may be attached to the objects to be washed again, rather than not being removed from the objects to be washed from the beginning.

That is, filth that has not been filtered by the filter 200 may be attached to the objects to be washed when wash water is sprayed again. Consequently, prevention of recontamination becomes a goal to be solved, rather than intensity of wash water, the spraying time of wash water, and the amount of wash water.

The inventors of the present application have tried to find a method capable of effectively filtering filth and effectively introducing the removed filth into the filter 200. In addition, the inventors have tried to find a method capable of effectively solving clogging of the filter 200 when the filter is clogged and thus wash water is not introduced.

The inventors of the present application have found that, in the case in which the level of water around the filter 200 is artificially changed, clogging of the filter is solved and filth clogging the filter 200 outside the filter is effectively introduced into the filter 200, as shown in FIG. 8. That is, the invertors have found that the above effect is achieved through a change in the level of water or a water falling effect. Specifically, the inventors have found that filth attached to the outside of the filter 200 floats while being separated from the filter when the level of water increases and that the floating filth smoothly flow into the filter 200 through the opening 202 and the inlet 203 of the filter 200 when the level of water decreases.

Large filth C or small filth D may be located around the filter 200. The filth may be attached to the inlet 203 of the filter, and may clog the inlet 203. As a result, wash water may not be smoothly introduced into the filter 200, which may cause deficiency of wash water, as described above.

At a low water level B, filth is placed on the upper surface of the support unit 300. Some of the filth may be attached to the inlet 203 of the filter 200. When the level of water is changed to a high water level A in this state, the filth may float. At this time, when spraying is performed, the level of water abruptly decreases. That is, a large amount of wash water is introduced into the filter through the opening 202 of the filter, whereby the level of water abruptly decreases. In particular, the level of water in the filter abruptly decreases.

Consequently, the filth around the filter is introduced into the filter through the opening 202 over the upper part of the filter. When the wash water is introduced into the filter 200, the wash water introduced into the filter 200 applies pressure in a direction opposite the radial direction of the inlet 203 of the filter 200. Consequently, the filth clogging the inlet 203 of the filter 200 may be separated from the inlet 203 of the filter 200, and may then move upwards. The filth that has moved upwards may be introduced into the filter 200 through the opening 202 of the filter.

It is possible to prevent clogging of the filter 200, to solve clogging of the filter, and to prevent deficiency of wash water by designing an artificial change in the level of water and a change frequency.

The amount of wash water that is capable of being supplied into the dishwasher is limited. When the washing pump 150 is operated to spray wash water, therefore, the wash water is sprayed into the tub 12, and a large amount of wash water is located in the channels, such as the spray arms 13, 14, and 15. As a result, the level of water around the filter 200 located at the lower part of the tub 12 abruptly decreases.

When pumping is stopped, the wash water falls downwards, whereby the level of water around the filter 200 abruptly increases. Consequently, it can be seen that the level of water is repeatedly changed by repeatedly performing pumping and pause of pumping. Pumping may be spraying, and pause of pumping may be pause of spraying. Consequently, this repetition may be referred to as intermittent driving.

As described above, conventional spraying is continuous spraying, rather than spraying and pause of spraying that are performed repeatedly. The reason for this is that spraying time is greatly considered. Of course, in a specific dishwasher, a pause may be performed after spraying. However, this is a pause for changing the rotational direction of the motor or changing the rotational direction of the spray arms. Consequently, pause time is very short, and the motor is rotated during a major portion of time. In addition, current is constantly supplied to the motor. That is, current having an opposite phase may be supplied to the motor even in a period in which an instantaneous pause is performed.

In contrast, intermittent driving in the present invention may be an artificial or forcible change in the level of water through artificial control, such as rotation and pause of the motor, supply of current to the motor and interruption of current supply, and spraying and pause of spraying.

FIG. 6 shows driving of the motor of the washing pump in an example of a washing cycle. Solid lines mean RPM of the motor, and dotted lines mean combinations of the spray arms 13, 14, and 15. As an example, in the case in which three spray arms perform spraying, there may be seven combinations of the spray arms. The combinations of the spray arms may be programmed so as to be preset.

The inventors of the present invention have considered the case in which the level of water is maximally changed. That is, the inventors have paid attention to time until the level of water maximally decreases after the pump starts and time until the level of water maximally increases after the pump stops. The reason for this is that, as fluctuation in the level of water increases, the water falling effect may be maximized.

Time required for sprayed wash water to fall to the lower part of the tub, i.e. the size of the tub, may be considered. The length and sectional area of the channels between the pump and the spray arms depending on the number or position of the spray arms may be considered. Time during which wash water is reintroduced from the lower part of the tub to the sump may also be considered. In the case in which these premises are changed, therefore, pumping time and pumping pause time may be somewhat changed.

It could be found that, in the case in which pumping and resupply of wash water are smoothly performed, the level of water can be minimized when pumping is continued for about 3 to 4 seconds or more. That is, it could be found that the minimum water level can be maintained when spraying is continued for time longer than about 3 to 4 seconds or more.

Also, it could be found that the level of water can be maximized when pumping is paused for about 3 to 4 seconds or more. It could be found that the maximum water level gradually decreases when spraying is paused for time longer than about 3 to 4 seconds or more. Also, it could be found that this decrease has a smaller decrease width than a decrease when spraying is performed again.

Consequently, it could be found that a change in the level of water can be maximized through pause of pumping for about 3 to 4 seconds and pumping for about 3 to 4 seconds. Therefore, it could be found that pause of pumping for time longer than 3 to 4 seconds is disadvantageous in terms of spraying efficiency and that pumping for time shorter than 3 to 4 seconds is also disadvantageous in terms of spraying efficiency. Consequently, it could be found that it is preferable to perform pause of pumping for about 3 to 4 seconds and to perform pumping for about 3 to 4 seconds or more. Of course, in the case in which pumping is performed for a very long time, water level change frequency is greatly lowered, whereby an effective water falling effect cannot be expected. Preferably, therefore, pumping is performed for less than 60 seconds.

At the intermittent driving step, the spraying time may be changed as described above. That is, the minimum time may be 3 to 4 seconds, and the maximum time may be about 30 to 60 seconds. Since the spraying pause time is 3 to 4 seconds, however, there is little margin for change. Consequently, the spraying pause time is not substantially changed, and the spraying time may be changed to change the water level change frequency. That the water level change frequency is high means that the spraying time is short as much as that, and that the water level change frequency is low means that the spraying time is long as much as that.

In the washing cycle, the preliminary washing cycle is performed to maximally separate filth from the objects to be washed. At this time, there may be filth having large particles or filth having relatively small particles, such as powdered red pepper, bread crumb, and coffee grounds.

In the initial stage of the preliminary washing cycle, therefore, it is preferable to perform intermittent driving having spraying time longer than spraying pause time. That is, it is preferable to control the actual operation rate of the motor so as to be higher. The actual operation rate of the motor is the ratio of ON time of the motor to the sum of ON time and OFF time of the motor. Consequently, that the actual operation rate of the motor is high means than that the motor driving rate is high, whereby the amount of wash water that is sprayed and time during which wash water is sprayed increase. Consequently, it is possible to effectively separate filth from the objects to be washed through intermittent driving having a high actual operation rate of the motor. At this time, through intermittent driving, large filth may not clog the filter and may be introduced into the filter though the opening of the upper filter portion through the water falling effect.

When large filth is introduced into the filter, small filth may clog the filter. In the case in which such filth is not appropriately filtered, the filth may circulate and contaminate the objects to be washed. The filth is introduced into the sump via channels other than the filter, and therefore it is preferable for small filth to be introduced toward the filter, rather than other channels.

As described above, the inclined surface is formed around the filter. That is, downward inclination is formed toward the filter. When the level of water decreases, therefore, filth may move toward the filter.

Therefore, it is preferable to perform intermittent driving having a low actual operation rate after intermittent driving having a high actual operation rate. That is, it is preferable to perform intermittent driving configured such that a repetition period of spraying and pause of spraying is shorter. Consequently, a water level change period is shorter, whereby it is possible to effectively filter small filth through the filter. In addition, filth attached to the outside of the filter may float due to an increase in the level of water and may be smoothly introduced into the filter through the opening of the filter due to a decrease in the level of water.

Meanwhile, in the preliminary washing cycle, intermittent driving having a high actual operation rate and intermittent driving having a low actual operation rate may be performed a plurality of times.

In FIG. 6, periods T1 and T3 are intermittent driving steps having a relatively high actual operation rate, and periods T2 and T4 are intermittent driving steps having a relatively low actual operation rate.

In addition to the intermittent driving steps, general spraying steps may be performed, and at this time the combination of the nozzles may be varied. However, it is not preferable to change the combination of the nozzles during the intermittent driving steps. In addition, it is preferable not to change target RPM. The reason for this is that it is effective to uniformly repeat fluctuation in the level of water.

FIG. 7 shows driving of the washing pump and the combination of the spray arms in the main washing cycle and the rinsing cycle.

Even in the main washing cycle and the rinsing cycle, it is preferable to perform intermittent driving at least once. It is preferable to perform intermittent driving at the last stage of the main washing cycle, since the intermittent driving is a process of introducing small filth into the filter.

Also, in the rinsing cycle, it is preferable to perform intermittent driving at the last stage of the rinsing cycle. Since the rinsing cycle is a process of finally rinsing dishes, however, it is preferable to perform a step of finishing the intermittent driving and removing residual filth in the dishwasher through continuous spraying.

In the main washing cycle and the rinsing cycle, intermittent driving is performed to prevent small filth from scattering again, i.e. being pumped again.

Meanwhile, the intermittent driving is capable of introducing even filth attached to the filter support unit around the filter and the inclined surface as well as the filter into the filter. Consequently, it is possible to prevent filth around the filter from moving to the sump via other channels. The reason for this is that, as the number of water level changes is increased, the amount of wash water that is discharged through the filter, rather than other channels, increases.

In FIG. 7, period T5 is an intermittent driving step in the main washing cycle, and period T6 is an intermittent driving step in the rinsing cycle. In periods T5 and T6, it is preferable to perform intermittent driving steps having a relatively low actual operation rate. The reason for this is that, since all large filth is considered to be filtered in the preliminary washing cycle, it is necessary to filter only small filth. That is, water level change frequency may be increased to effectively filter small filth.

Meanwhile, according to this embodiment, the sectional area of wash water that penetrates the filter so as to be introduced from the tub into the sump is smaller than the sectional area of wash water that penetrates the filter so as to be introduced from the interior of the filter to the washing pump. That is, the former is located outside the sump, and the latter is located inside the sump. In the case of the former, filth clogs the exterior of the filter. In the case of the latter, filth clogs the interior of the filter.

Figure 9:
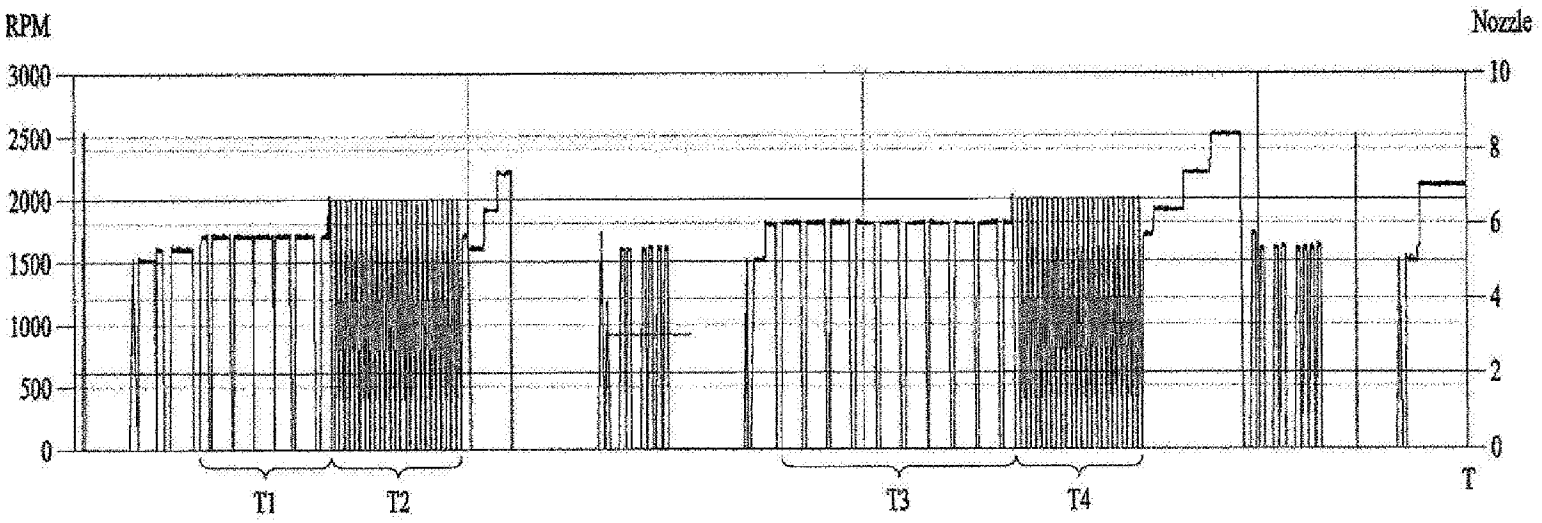
FIG. 9 is a view showing a control method at the time of filter washing of the dishwasher according to the embodiment of the present invention.

FIG. 9 is a view showing a control method at the time of filter washing of the dishwasher according to the embodiment of the present invention, and FIGS. 10 to 13 are views showing a process of removing filth from the filter at the time of filter washing of the dishwasher according to the embodiment of the present invention.

The controller 29 performs main washing drainage (P349) at the last step of the main washing (P340). In the main washing drainage (P349), the controller 29 drives the drainage pump 25 to drain wash water stored in the water collection portion 100*a* of the sump 100 outside. When the controller 29 drives the drainage pump 25, wash water stored in the water collection portion 100*a* of the sump 100 is discharged from the case 11 via the drainage channel 24.

When the wash water stored in the water collection portion 100*a* of the sump 100 is completely drained, the controller 29 stops the drainage pump 25 and performs filter washing (P350).

The controller 29 performs water supply (P351) of the filter washing (P350). In the water supply (P351), the controller 29 controls the water supply valve 22 to supply wash water from the external water source to the sump 100. When the controller 29 opens the water supply valve 22, the wash water supplied from the external water source is introduced into the water collection portion 100*a* of the sump 100 via the water supply channel 23. The controller 29 controls the water supply valve 22 such that the level of the wash water supplied to the water collection portion 100*a* of the sump 100 is lower than the bottom 12*b* of the tub 12.

Figure 10:
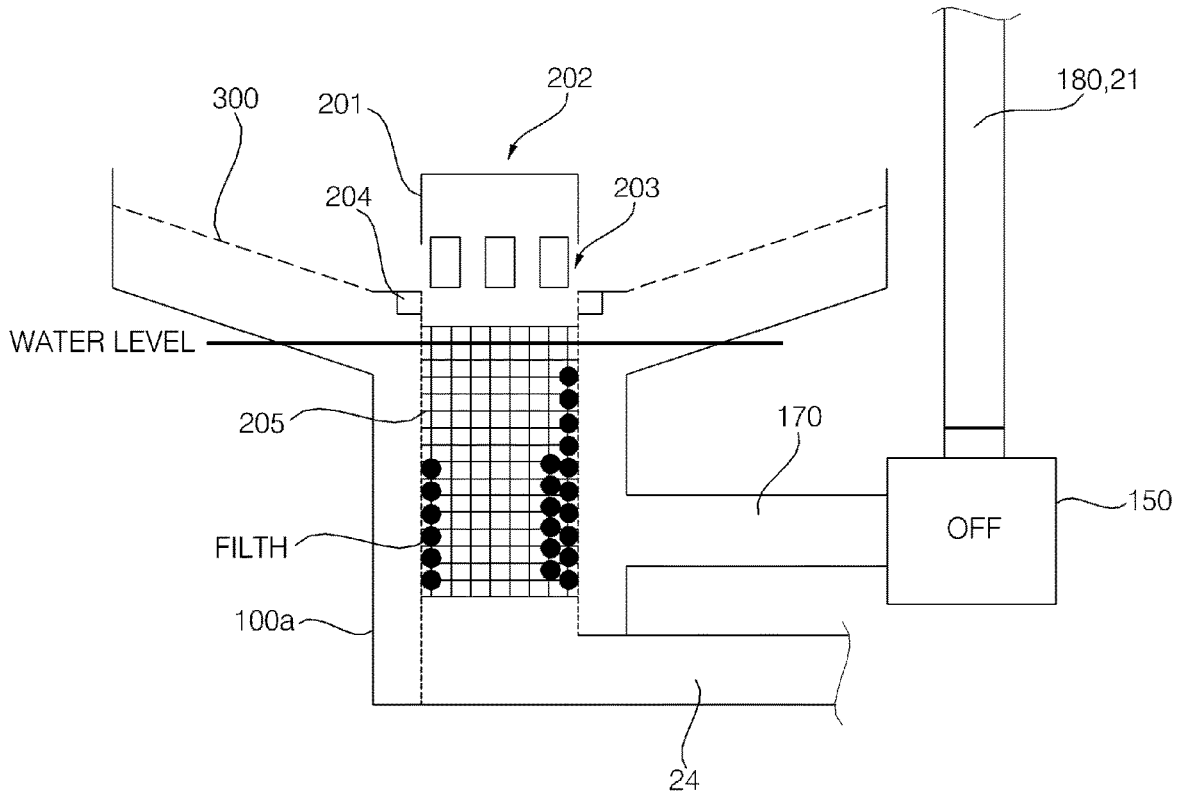
FIGS. 10 to 13 are views showing a process of removing filth from the filter at the time of filter washing of the dishwasher according to the embodiment of the present invention.

Referring to FIG. 10, after completion of the water supply (P351), the level of the wash water supplied to the water collection portion 100*a* of the sump 100 is lower than the bottom 12*b* of the tub 12. The level of the wash water supplied to the water collection portion 100*a* of the sump 100 is lower than the lowermost point of the support unit 300, which defines the bottom 12*b* of the tub 12. Preferably, the level of the wash water supplied to the water collection portion 100*a* of the sump 100 is lower than the lower end of the inlet 203 of the filter 200 and does not exceed the upper end of the mesh portion 205.

At the time of water supply (P351), the controller 29 does not drive the washing pump 150 and the drainage pump 25.

When the water supply (P351) is completed, the controller 29 performs wash water movement (P352). In the wash water movement (P352), the controller 29 controls the switch valve 130 to interconnect the wash water supply channel 180 and the top spray arm connection channel 21 such that wash water pumped by the washing pump 150 is sprayed through the top spray arm 15 disposed at the uppermost end. In some embodiments, at the time of water supply (P351) of the filter washing (P350), the controller 29 may control the switch valve 130 to interconnect the wash water supply channel 180 and the top spray arm connection channel 21.

In the wash water movement (P352), the controller 29 drives the washing pump 150 to pump the wash water stored in the water collection portion 100*a* of the sump 100 to the top spray arm 15, and stops the washing pump 150 to collect the wash water pumped to the top spray arm 15 to the water collection portion 100*a* of the sump 100.

Referring to FIG. 9, in the wash water movement (P352), it is preferable for the controller 29 to repeatedly drive the washing pump 150 for a predetermined driving time and pause the driving of the washing pump 150 for a predetermined pause time. That is, the wash water movement (P352) may be intermittent driving of intermittently driving the washing pump 150 to change the level of water around the filter 200. In the wash water movement (P352), the controller 29 intermittently drives the washing pump 150 such that the level of water around the filter 200 is changed within the height of the mesh portion 205.

Driving time is time required for the washing pump 150 to pump all the wash water stored in the water collection portion 100*a* of the sump 100 to the water collection channel 170, the wash water supply channel 180, the top spray arm connection channel 21, and/or the top spray arm 15, and pause time is time required to collect all the wash water pumped to the water collection channel 170, the wash water supply channel 180, the top spray arm connection channel 21, and/or the top spray arm 15 to the water collection portion 100*a* of the sump 100. It is preferable for the driving time to be within time within which wash water is not sprayed through the top spray arm 15. In this embodiment, the driving time is 4 seconds, and the pause time is 1 second.

Figure 11:
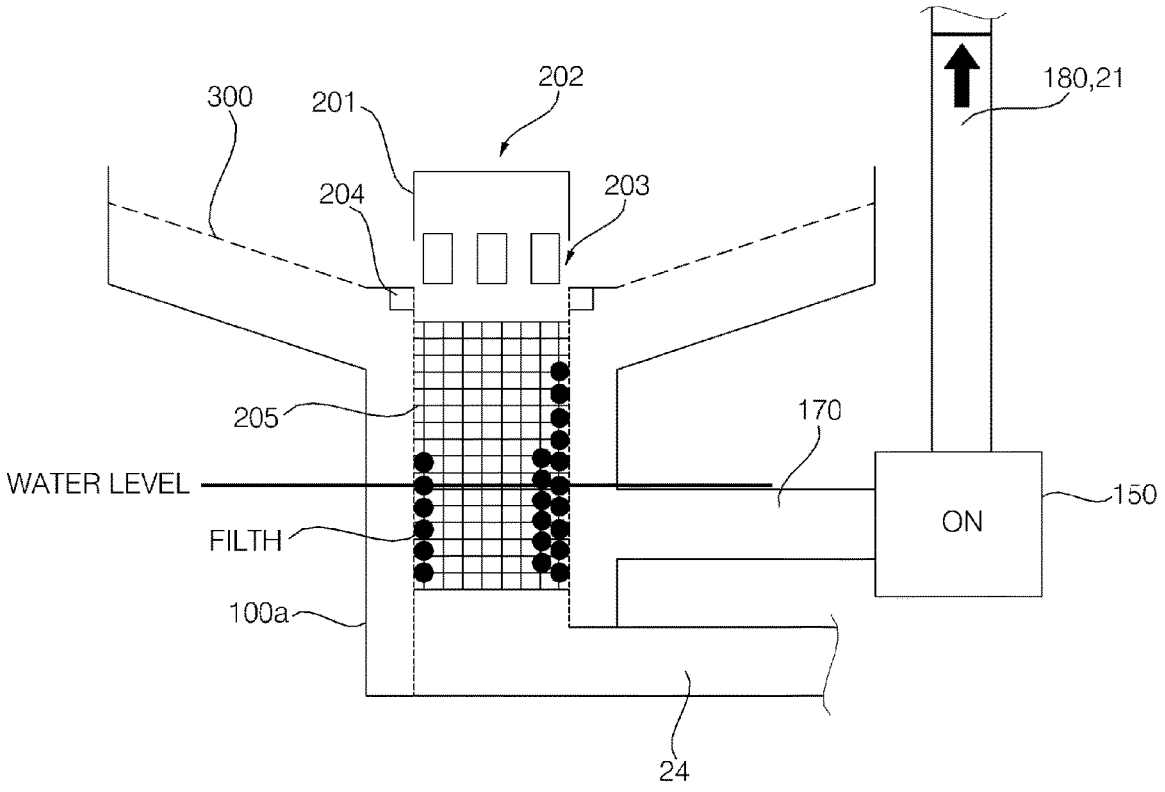

Referring to FIG. 11, when the washing pump 150 is driven, the wash water stored in the water collection portion 100*a* of the sump 100 is pumped to the top spray arm 15 via the wash water pumped to the water collection channel 170, the wash water supply channel 180, and the top spray arm connection channel 21. In some embodiments, wash water may be sprayed through the top spray arm 15, may be pumped to the top spray arm connection channel 21, or may be pumped to the wash water supply channel 180 depending on the driving time during which the washing pump 150 is driven. In this embodiment, when the washing pump 150 is driven, wash water is pumped to the top spray arm connection channel 21.

Figure 12:
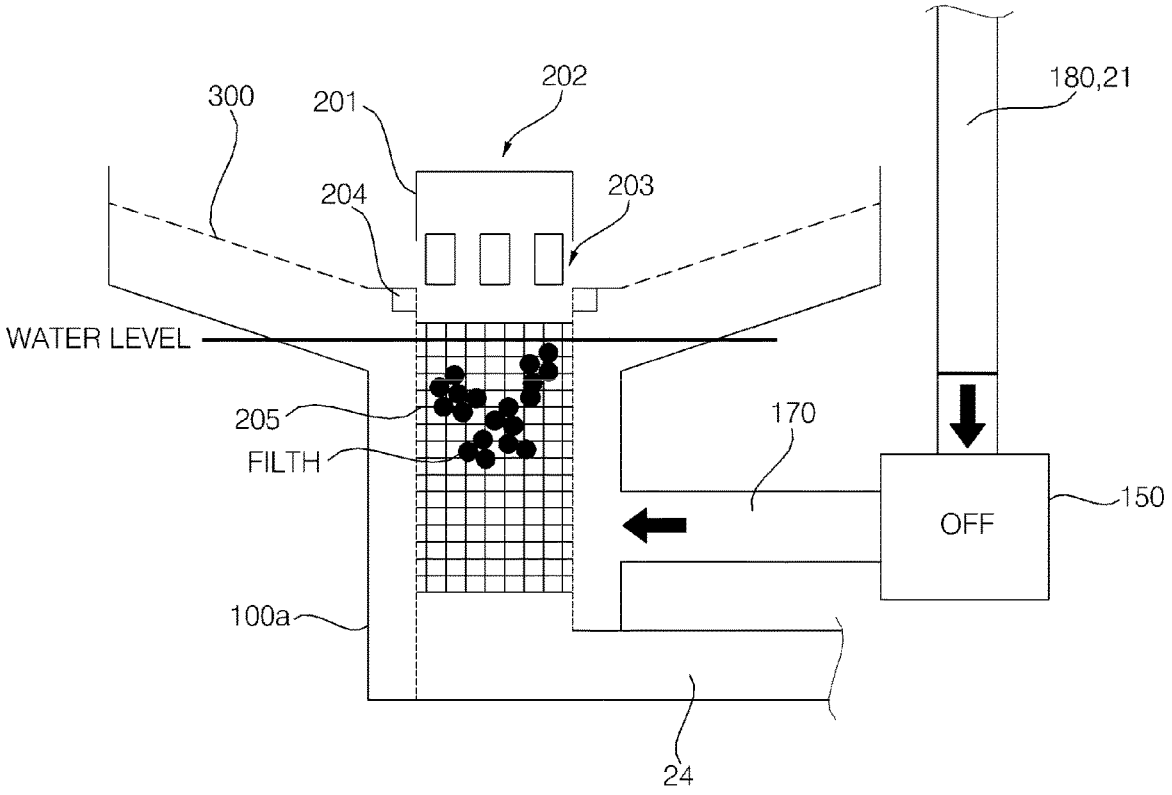

Referring to FIG. 12, when the washing pump 150 is paused, the wash water pumped to the water collection channel 170, the wash water supply channel 180, the top spray arm connection channel 21, and/or the top spray arm 15 is collected in the water collection portion 100*a* of the sump 100. When the washing pump 150 is paused, the wash water in the top spray arm connection channel 21 flows backwards to the water collection portion 100*a* of the sump 100 due to gravity and separates filth from the mesh portion 205 of the mesh 200 at the time of backward-flow thereof. The separated filth floats in the wash water.

When the washing pump 150 is paused, the level of water collected to the collection portion 100*a* of the sump 100 after the lapse of the pause time is lower than the bottom 12*b* of the tub 12. The level of the wash water collected to the water collection portion 100*a* of the sump 100 is lower than the lowermost point of the support unit 300, which defines the bottom 12*b* of the tub 12. Preferably, the level of the wash water collected in the water collection portion 100*a* of the sump 100 is lower than the lower end of the inlet 203 of the filter 200 and does not exceed the upper end of the mesh portion 205.

Figure 13:
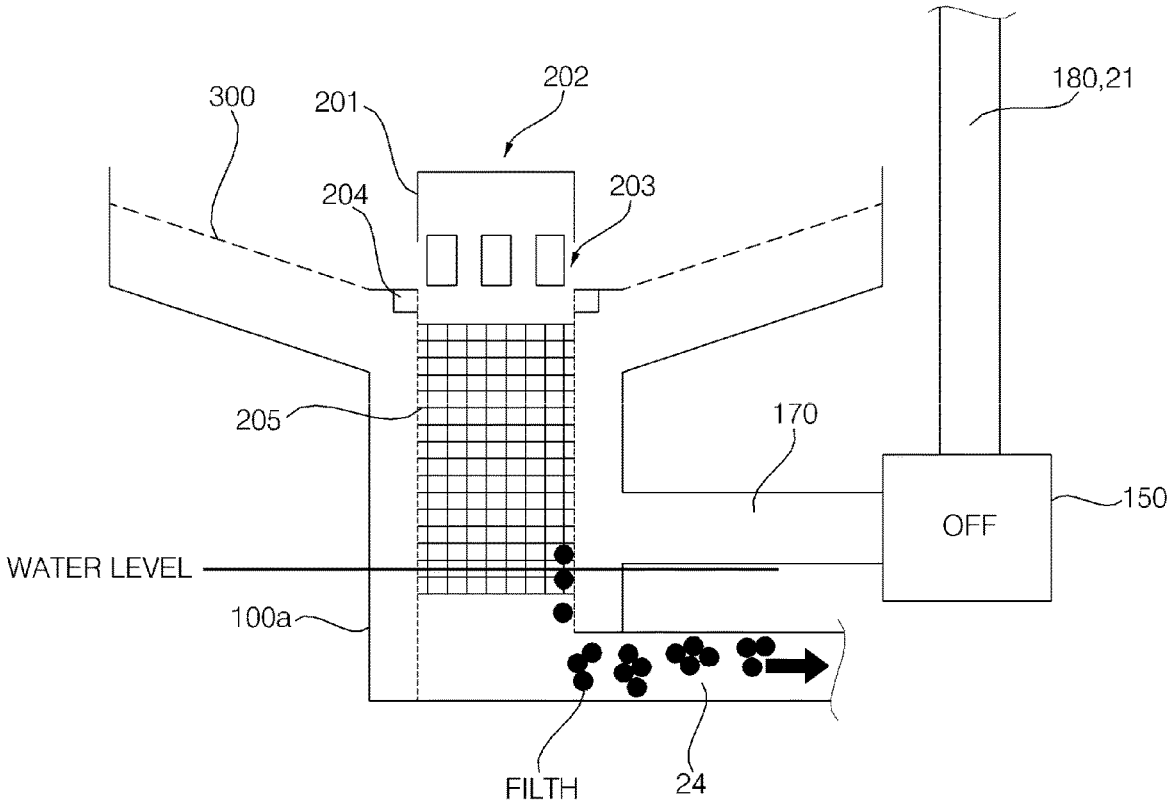

When the wash water movement (P352) is completed after repeating the driving and pause of the washing pump 150 a predetermined number of times, the controller 29 performs drainage (P353). In the drainage (P353), the controller drives the drainage pump 25 to drain the wash water stored in the water collection portion 100*a* of the sump 100 outside. When the controller 29 drives the drainage pump 25, as shown in FIG. 13, the wash water stored in the water collection portion 100*a* of the sump 100 is discharged from the case 11 via the drainage channel 24 together with the filth.

In some embodiments, the water supply (P351) of the filter washing (P350) may be omitted. In the case in which the water supply (P351) is omitted, the controller 29 controls the drainage pump 25 such that all the wash water stored in the water collection portion 100*a* of the sump 100 is not drained but some of the wash water remains in the main washing drainage (P349) of the main washing (P340).

At this time, the level of wash water remaining in the water collection portion 100*a* of the sump 100 is lower than the bottom 12*b* of the tub 12, and is lower than the lowermost point of the support unit 300, which defines the bottom 12*b* of the tub 12. Preferably, the level of the wash water remaining in the water collection portion 100*a* of the sump 100 is lower than the lower end of the inlet 203 of the filter 200 and does not exceed the upper end of the mesh portion 205.

Although the filter washing (P350) has been described as being performed after the main washing (P340), the filter washing may also be performed after the preliminary washing 3 (P330).

Figure 14:
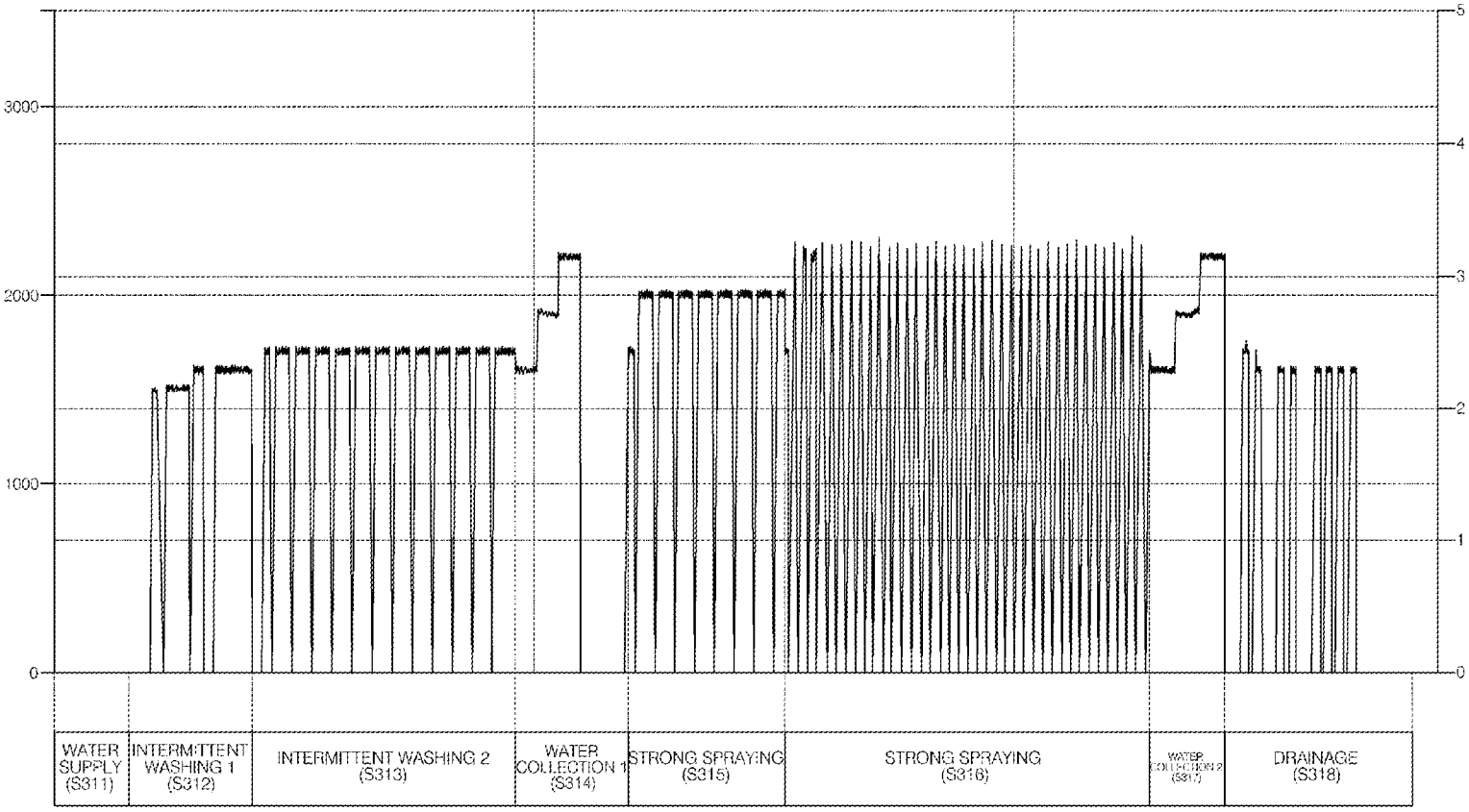
FIG. 14 is a view showing a control method at the time of preliminarily washing of the dishwasher according to the embodiment of the present invention.
Figure 15:
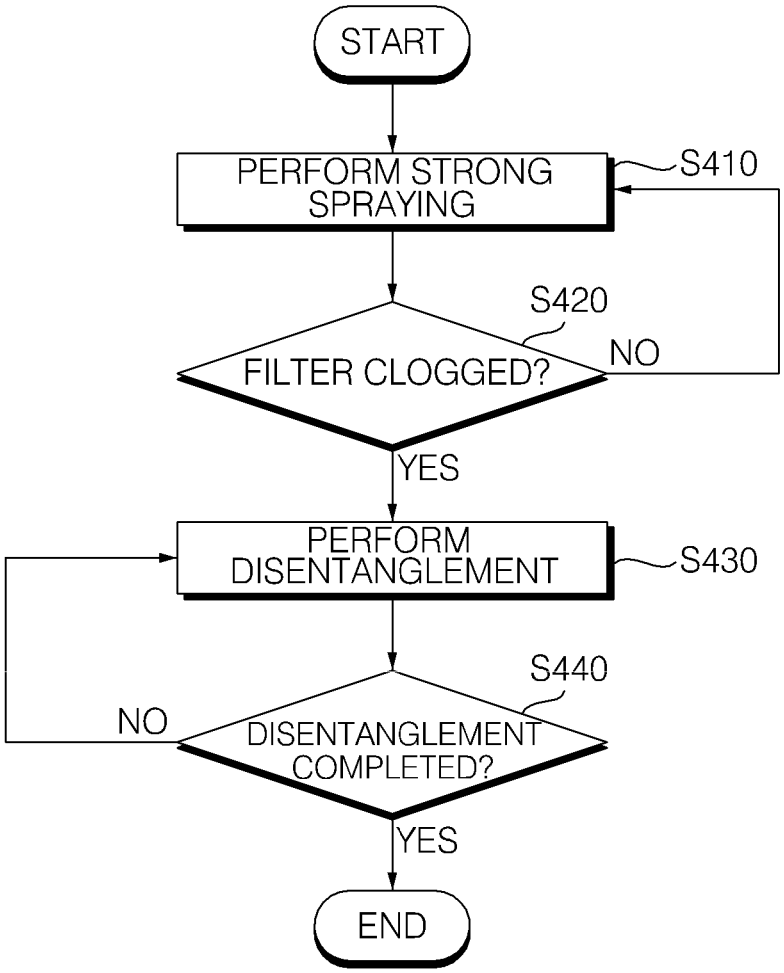
FIG. 15 is a flowchart showing the method of controlling the dishwasher according to the embodiment of the present invention.

FIG. 14 is a view showing a control method at the time of preliminarily washing of the dishwasher according to the embodiment of the present invention, and FIG. 15 is a flowchart showing the method of controlling the dishwasher according to the embodiment of the present invention.

The preliminary washing 1 (P310) includes water supply (S311) of supplying wash water, intermittent washing 1 (S312) and intermittent washing 2 (S313) of supplying wash water to objects to be washed to remove filth from the objects to be washed, water collection 1 (S314) of collecting wash water in the tub 12 to the sump 100, strong spraying (S315) of strongly spraying wash water through one of the spray arms 13, 14, and 15 to remove filth from the objects to be washed, disentanglement (S316) of intermittently spraying wash water through all of the spray arms 13, 14, and 15 to solve clogging of the filter 200 in the case in which the inlet 203 of the filter 200 is clogged by filth, water collection 2 (S317) of collecting wash water in the tub 12 to the sump 100, and drainage (S318) of discharging the wash water stored in the sump 100 outside.

In the water supply (S311), the controller 29 opens the water supply valve 22 to supply wash water from the external water source into the water collection portion 100*a* of the sump 100. When the water supply valve 22 is opened, the wash water supplied from the external water source is introduced into the water collection portion 100*a* of the sump 100 via the water supply channel 23 so as to be stored into the water collection portion 100*a*.

In some embodiments, at the time of the water supply (S311), the controller 29 may open to drain wash water remaining in the water collection portion 100*a* in the previous cycle or the previous washing outside. In addition, at the time of the water supply (S311), the controller 29 may drive the washing pump 150 to collect wash water remaining in the spray arm connection channels 18, 19, and 21 in the previous cycle or the previous washing to the sump 100.

In the intermittent washing 1 (S312) and the intermittent washing 2 (S313), the controller 29 drives the washing pump 150 to pump wash water in the water collection portion 100*a* of the sump 100, and controls the switch valve 130 to spray wash water through at least one of the spray arms 13, 14, and 15. In the intermittent washing 1 (S312) and the intermittent washing 2 (S313), which are steps of applying wash water to the objects to be washed, spice or small filth is removed from the objects to be washed. The controller 29 performs control such that the maximum speed of the washing pump 150 is not relatively high, whereby the maximum intensity of wash water sprayed through the at least one of the spray arms 13, 14, and 15 is not high. The speed of the washing pump 150 means the rotational speed of the motor of the washing pump 150. It is preferable for the maximum speed of the washing pump 150 in the intermittent washing 1 (S312) to be lower than the maximum speed of the washing pump 150 in the intermittent washing 2 (S313). In this embodiment, it is preferable for the maximum speed of the washing pump 150 in the intermittent washing 1 (S312) to be about 1600 rpm and for the maximum speed of the washing pump 150 in the intermittent washing 2 (S313) to be about 1700 rpm.

In the intermittent washing 1 (S312) and the intermittent washing 2 (S313), it is preferable for the controller 29 to intermittently drive the washing pump 150. In the intermittent washing 1 (S312), it is preferable for the controller 29 to drive the washing pump 150 in various periods. In the intermittent washing 2 (S313), it is preferable for the controller 29 to drive the washing pump 150 in uniform periods. In this embodiment, the controller 29 drives the washing pump 150 for 14 seconds and pauses the washing pump for 1 second in the intermittent washing 2 (S313), which is repeated.

In the intermittent washing 1 (S312) and the intermittent washing 2 (S313), the controller 29 controls the switch valve 130 to spray wash water through at least one of the spray arms 13, 14, and 15. In this embodiment, the controller 29 controls the switch valve 130 to spray wash water through the lower spray arm 13 in the intermittent washing 1 (S312) and the intermittent washing 2 (S313).

In the water collection 1 (S314), the controller 29 drives the washing pump 150 to pump wash water in the water collection portion 100*a* of the sump 100, and controls the switch valve 130 to spray wash water through the top spray arm 15. The controller 29 sprays wash water from above to below through the top spray arm 15 disposed at the uppermost end to collect wash water present on the objects to be washed in the tub 12 and the bottom 12*b* of the tub 12 to the sump 100. It is preferable for the controller 29 to increase the speed of the washing pump 150 stepwise until the maximum speed thereof is 2200 rpm.

In the water collection 1 (S314), it is preferable for the controller 29 to interrupt the driving of the washing pump 150 and to sense turbidity of wash water collected in the water collection portion 100*a* of the sump 100 through a turbidity sensor (not shown). The controller 29 sets the amount of wash water that is supplied in subsequent cycles, operation time of each cycle, and the number of repetitions of each cycle based on the turbidity of wash water sensed through the turbidity sensor. For example, in the case in which the turbidity of wash water sensed by the turbidity sensor is high, the controller 29 may repeat preliminary washing about 5 times such that washing is performed up to preliminary washing 5.

In the strong spraying (S315), the controller 29 drives the washing pump 150 to pump wash water in the water collection portion 100*a* of the sump 100, and controls the switch valve 130 to spray wash water through one of the spray arms 13, 14, and 15. In the strong spraying (S315), the maximum intensity of wash water sprayed through one of the spray arms 13, 14, and 15 is increased such that most of the filth attached to the objects to be washed is separated therefrom. The controller 29 increases the maximum speed of the washing pump 150 so as to be relatively high, and controls the switch valve 130 to spray wash water through the lower spray arm 13. In this embodiment, it is preferable for the maximum speed of the washing pump 150 to be about 2000 rpm. The controller 29 increases the maximum speed of the washing pump 150 so as to be relatively high, and sprays wash water from below to above through the lower spray arm 13 to efficiently remove filth from the objects to be washed.

In the strong spraying (S315), it is preferable for the controller 29 to intermittently drive the washing pump 150. In the strong spraying (S315), it is preferable for the controller 29 to drive the washing pump 150 in uniform periods. In this embodiment, the washing pump 150 is driven for 14 seconds and is paused for 1 second, which is repeated.

In the strong spraying (S315), the controller 29 measures a value of current at the time of driving the washing pump 150, determines whether the filter 200 is clogged based on the measure value of current, and performs the disentanglement (S316) upon determining that the filter 200 is clogged.

The controller 29 performs the strong spraying (S315) for a predetermined time, and in the case in which clogging of the filter 200 is not sensed, stops the strong spraying (S315) after the lapse of the predetermined time, and performs the water collection 2 (S317), a description of which will follow.

In the disentanglement (S316), the controller 29 intermittently drives the washing pump 150 to pump wash water in the water collection portion 100*a* of the sump 100, and controls the switch valve 130 to spray wash water through all the spray arms 13, 14, and 15. The disentanglement (S316) is performed in the case in which the controller 29 senses clogging of the filter 200 through the value of current of the washing pump 150 in the strong spraying (S315).

In the disentanglement (S316), the controller 29 drives the washing pump 150 in relatively short periods such that fluctuation in the flow rate of wash water that is circulated is high, and sprays wash water through all the spray arms 13, 14, and 15. The controller 29 greatly increases the maximum speed of the washing pump 150. In this embodiment, it is preferable for the maximum speed of the washing pump 150 to be about 2200 rpm. Even when the controller 29 maximally increases the maximum speed of the washing pump 150, the intensity of wash water sprayed in the disentanglement (S316) is lower than the intensity of wash water sprayed in the strong spraying (S315), since wash water is sprayed through all the spray arms 13, 14, and 15.

In the disentanglement (S316), the controller 29 drives the washing pump 29 in relatively short uniform periods. In this embodiment, the controller 29 drives the washing pump 150 for 6 seconds and pauses the driving of the washing pump for 1 second, which is repeated.

In the disentanglement (S316), the controller 29 measures a value of current at the time of driving the washing pump 150, determines whether the clogged filter 200 is disentangled based on the measure value of current, and stops the disentanglement (S316) upon determining that the clogged filter 200 is disentangled.

In the water collection 2 (S317), the controller 29 drives the washing pump 150 to pump wash water in the water collection portion 100*a* of the sump 100, and controls the switch valve 130 to spray wash water through the top spray arm 15. The controller 29 sprays wash water from above to below through the top spray arm 15 disposed at the uppermost end to collect wash water present on the objects to be washed in the tub 12 and the bottom 12*b* of the tub 12 to the sump 100. It is preferable for the controller 29 to increase the speed of the washing pump 150 stepwise until the maximum speed thereof is 2200 rpm. In the water collection 2 (S317), it is not necessary to sense turbidity. After the water collection 2 (S317) is performed, therefore, the drainage (S318) is performed.

In the drainage (S318), the controller 29 drives the drainage pump 25 to drain wash water in the sump 100 outside. In the drainage (S318), it is preferable for the controller 29 to intermittently drive the drainage pump 25. In the initial stage of the drainage (S318), the controller 29 may intermittently drive the washing pump 150 to collect wash water remaining in the spray arm connection channels 18, 19, and 21 to the sump 100, and may drain the wash water.

In some embodiments, at least one of the intermittent washing 1 (S312), the intermittent washing 2 (S313), the water collection 1 (S314), or the water collection 2 (S317) may be omitted. That is, the water supply (S311), the strong spraying (S315), and the drainage (S318) must be performed in the preliminary washing 1 (P310) of this embodiment, and the disentanglement (S316) is performed depending on whether the filter 200 is clogged. In addition, the water supply (S311), the strong spraying (S315), the disentanglement (S316), and the drainage (S318) may be performed in the preliminary washing 2 (P320) and/or the preliminary washing 3 (P330).

The controller 29 drives the washing pump 150 to perform the strong spraying (S315) in which wash water is sprayed through one of the spray arms 13, 14, and 15 (S410). As described above, the controller 29 increases the maximum speed of the washing pump 150 so as to be relatively high, and controls the switch valve 130 to spray wash water through the lower spray arm 13. The speed of the washing pump 150 in the strong spraying (S315) is lower than the speed of the washing pump 150 in the disentanglement (S316). The controller 29 intermittently drives the washing pump 150. The driving period of the washing pump 150 in the strong spraying (S315) is longer than the driving period of the washing pump 150 in the disentanglement (S316).

The controller 29 performs the strong spraying (S315) and determines whether the filter 200 is clogged (S420). In the case in which the filter 200 is clogged, sufficient wash water is not collected in the water collection portion 100*a* of the sump 100, whereby the value of current of the washing pump 150 decreases. Consequently, the controller 29 measures the value of current of the washing pump 150 to determine whether the filter 200 is clogged.

The controller compares the value of current of the washing pump 150 at the time of driving the washing pump 150 with a predetermined clogging determination current value, and determines that the filter 200 is clogged when the case in which the value of current of the washing pump 150 is lower than the clogging determination current value occurs a predetermined number of times.

In this embodiment, the controller 29 measures the value of current of the washing pump 150 at intervals of 1 second during 14 seconds during which the washing pump 150 is driven. When the case in which the value of current of the washing pump 150 measured every second is lower than the clogging determination current value occurs 5 times or more, the controller 29 determines that the filter 200 is clogged.

Upon not determining that the filter 200 is clogged, the controller 29 continuously performs the strong spraying (S315). Upon not determining clogging of the filter 200 for a predetermined time, the controller 29 stops the strong spraying (S315), and performs the water collection 2 (S317). In some embodiments, the drainage (S318) is performed.

Upon determining that the filter 200 is clogged, the controller 29 performs the disentanglement (S316) (S430). As described above, the controller 29 intermittently drives the washing pump 150 to intermittently spray wash water through all the spray arms 13, 14, and 15. In the disentanglement (S316), the controller drives the washing pump 150 in relatively short periods, greatly increases the maximum speed of the washing pump 150, and sprays wash water through all the spray arms 13, 14, and 15 such that fluctuation in the flow rate of wash water that is circulated is great.

The driving period of the washing pump 150 in the disentanglement (S316) is shorter than the driving period of the washing pump 150 in the strong spraying (S315), and the speed of the washing pump 150 in the disentanglement (S316) is higher than the speed of the washing pump 150 in the strong spraying (S315).

In the disentanglement (S316), when fluctuation in the flow rate of wash water is increased, the level of wash water is changed in abruptly short periods. That is, the disentanglement (S316) may be intermittent driving in which the controller 29 intermittently drives the washing pump 150 to change the level of water around the filter 200. In the disentanglement (S316), the controller 29 intermittently drives the washing pump 150 such that the level of water around the filter 200 is changed between the lower end of the inlet 203 and the upper side of the opening 202.

Referring to FIG. 8, very large filth C or relatively large filth D may be located around the filter 200. The filth C and D may clog the inlet 203 of the filter 200. As a result, wash water may not be smoothly introduced into the filter 200 through the inlet 203 of the filter 200.

At the low water level B, filth C and D is placed on the upper surface of the support unit 300. Some of the filth may be attached to the inlet 203 of the filter 200. It is preferable for the low water level B to be equal to or higher than the lower end of the inlet 203. When the driving of the washing pump 150 is stopped in this state in order to abruptly increase the level of wash water, the filth C and D may float up to the high water level A. It is preferable for the high water level A to be higher than the opening 202 of the filter 200.

At this time, when the washing pump 150 is driven at high speed, the level of wash water abruptly decreases. In particular, the level of wash water in the filter 200 abruptly decreases. Consequently, the wash water is rapidly introduced through the opening 202 formed in the upper end of the filter 200, and the filth C and D floating at the high water level A is also introduced into the filter 200 through the opening 202 together with the wash water introduced through the opening 202.

In addition, some of the wash water rapidly introduced through the opening 202 of the filter 200 is discharged through the inlet 203 of the filter 200 to separate filth C from the inlet 203 of the filter 200. The filth C separated from the inlet 203 of the filter 200 floats when the level of wash water abruptly increases, thereby solving clogging of the filter 200. The clogging of the filter 200 is solved through an abrupt change in the level of wash water, whereby the clogged filter 200 is disentangled.

The controller 29 determines whether the disentanglement of the clogged filter 200 is completed while performing the disentanglement (S316) (S440). In the case in which the clogged filter 200 is disentangled, sufficient wash water is collected in the water collection portion 100*a* of the sump 100, whereby the value of current of the washing pump 150 increases. Consequently, the controller 29 measures the value of current of the washing pump 150 to determine whether disentanglement of the filter is completed. In the disentanglement (S316), the washing pump 150 is driven in short periods, and the value of current of the washing pump 150 temporarily increases. For this reason, it is difficult to determine that the filter 200 is disentangled. Consequently, the measured value of current of the washing pump 150 is integrated to determine whether the filter 200 is disentangled.

The controller 29 compares a value (an integrated value) obtained by integrating the value of current of the washing pump 150 measured during the driving period of the washing pump 150 with a predetermined disentanglement determination value, and determines that the disentanglement of the filter is completed in the case in which the integrated value is greater than the disentanglement determination value.

In this embodiment, the controller 29 compares an integrated value obtained by integrating the value of current of the washing pump 150 measured during 6 seconds during which the washing pump 150 is driven with the disentanglement determination value, and determines that the disentanglement of the filter is completed in the case in which the integrated value is greater than the disentanglement determination value.

Upon not determining that disentanglement of the filter is completed, the controller 29 continuously perform the disentanglement (S316). Upon determining that disentanglement of the filter is completed, the controller 29 stops the disentanglement (S316) and performs the water collection 2 (S317). In some embodiments, the drainage (S318) is performed.

In the above embodiment, intermittent driving for solving clogging of the filter 200 has been described as the wash water movement (P352) and the disentanglement (S316). Both the wash water movement (P352) and the disentanglement (S316) may be performed in an embodiment. That is, the disentanglement (S316) may be performed in one of the preliminary washing (P310, P320, and P330), and the filter washing (P350) including the wash water movement (P352) may be performed in the main washing (P340) and/or the preliminary washing 3 (P330).

The difference between the wash water movement (P352) and the disentanglement (S316) is as follows. In the wash water movement (P352), the washing pump 150 is intermittently driven such that the level of water in the water collection portion 100*a* of the sump 100 is changed between the upper end and the lower end of the mesh portion 205 to remove filth from the mesh portion 205. In the disentanglement (S316), the washing pump 150 is intermittently driven such that the level of water in the water collection portion 100*a* of the sump 100 is changed between the lower end of the inlet 203 and the upper side of the opening 202 (the upper end of the inlet 203) to remove filth from the inlet 203.

It will be apparent that, although the preferred embodiments have been shown and described above, the present invention is not limited to the above-described specific embodiments, and various modifications and variations can be made by those skilled in the art without departing from the gist of the appended claims. Thus, it is intended that the modifications and variations should not be understood independently of the technical spirit or prospect of the present invention.

INDUSTRIAL APPLICABILITY

The present invention may be utilized in various washers each having a filter provided in a water circulation channel.

The invention claimed is:

1. A method of controlling a dishwasher that includes a plurality of spray arms configured to spray wash water, a sump configured to receive wash water, a filter provided at the sump so as to filter wash water, and a washing pump configured to pump the wash water received in the sump to the spray arms, the method comprising:

a water supplying step of supplying wash water from an external water source to the sump;

a driving step of driving the washing pump to pump the wash water received in the sump to at least one of the plurality of spray arms through a wash water supply channel;

a stopping step of stopping the washing pump to collect, at the sump, the wash water pumped to the at least one of the spray arms; and a draining step of draining the wash water collected in the sump to an outside of the sump based on the driving step and the stopping step being finished, wherein the driving step and the stopping step are finished based on a value obtained by integrating a value of current of the washing pump measured during a driving period of the washing pump in the driving step being greater than a predetermined value.

2. The method according to claim 1, wherein:

the filter comprises an inlet formed in an upper circumference thereof so as to allow wash water in a tub to be introduced therethrough and a mesh portion disposed at a lower part thereof so as to collect filth, and in the stopping step, a level of water collected in the sump is lower than a lower end of the inlet and does not exceed an upper end of the mesh portion.

3. The method according to claim 1, wherein:

the plurality of spray arms are disposed to be spaced apart from each other in a vertical direction, and in the driving step, the washing pump pumps wash water to a spray arm disposed at the highest position, among the plurality of spray arms.

4. The method according to claim 1, wherein, in the water supplying step, a level of the wash water supplied to the sump is lower than a bottom of a tub.

5. The method according to claim 1, wherein:

the filter comprises an inlet formed in an upper circumference thereof so as to allow wash water in a tub to be introduced therethrough and a mesh portion disposed at a lower part thereof so as to collect filth, and in the water supplying step, a level of the wash water supplied to the sump is lower than a lower end of the inlet and does not exceed an upper end of the mesh portion.

6. The method according to claim 1, wherein:

the driving step is performed for a predetermined driving time, the stopping step is performed for a predetermined stopping time, and the predetermined driving time is longer than the predetermined stopping time.

7. The method according to claim 1, wherein the driving step and the stopping step are repeatedly performed.

8. The method according to claim 7, wherein the draining step is performed after repetition of the driving step and the stopping step.

9. The method according to claim 1, further comprising a spraying step of driving the washing pump to spray the wash water through at least one of the plurality of spray arms after the water supplying step.

10. The method according to claim 9, wherein:

the plurality of spray arms are disposed to be spaced apart from each other in a vertical direction, and in the spraying step, the wash water is sprayed through a spray arm disposed at the lowest position so as to spray the wash water upward, among the plurality of spray arms.

11. The method according to claim 9, wherein:

in the spraying step, the washing pump is intermittently driven to intermittently spray wash water, and a driving period of the washing pump at the spraying step is longer than a driving period of the washing pump at the driving step.

12. The method according to claim 9, wherein, in the spraying step, a value of current of the washing pump is compared with a predetermined clogging determination current value.

13. The method according to claim 12, wherein the driving step is performed when a case in which a measured value of current of the washing pump is lower than a predetermined reference value occurs a predetermined number of times at the spraying step.

14. The method according to claim 9, wherein a speed of the washing pump in the spraying step is lower than a speed of the washing pump in the driving step.

15. A dishwasher comprising:

a tub configured to receive a target object;

a plurality of spray arms configured to spray wash water into the tub;

a sump configured to receive wash water;

a filter configured to filter wash water sprayed from at least one of the spray arms and received in the sump;

a washing pump configured to pump the wash water received in the sump;

a water supply valve configured to supply wash water from an external water source to the sump;

a drainage pump configured to drain the wash water; and a controller configured to control the washing pump and the water supply valve, wherein the controller is configured:

to control the water supply valve in order to supply the wash water from the external water source to the sump, to control the washing pump to pump the wash water received in the sump to at least one of the spray arms through a wash water supply channel, to control the washing pump to stop to collect, at the sump, the wash water pumped to the at least one of the spray arms, to obtain a value by integrating a value of current of the washing pump measured during a driving period of the washing pump, and to control the drainage pump to drain the wash water collected in the sump to an outside of the sump based on the obtained value being greater than a predetermined value.

16. The dishwasher according to claim 15, wherein:

the filter comprises an inlet formed in an upper circumference thereof so as to allow wash water in the tub to be introduced therethrough and a mesh portion disposed at a lower part thereof so as to collect filth, and the controller is configured to control the washing pump and the water supply valve such that a level of water around the filter is changed between an upper end and a lower end of the mesh portion.

17. The dishwasher according to claim 15, wherein:

the filter comprises an inlet formed in an upper circumference thereof so as to allow wash water in the tub to be introduced therethrough and a mesh portion disposed at a lower part thereof so as to collect filth, and the controller is configured to control the washing pump and the water supply valve such that a level of water around the filter is changed between an upper side of an upper end of the inlet and a lower end of the inlet.

* * * * *